US006418408B1

(12) United States Patent
Udaya Bhaskar et al.

(10) Patent No.: US 6,418,408 B1
(45) Date of Patent: Jul. 9, 2002

(54) FREQUENCY DOMAIN INTERPOLATIVE SPEECH CODEC SYSTEM

(75) Inventors: Bangalore R. Udaya Bhaskar, North Potomac; Srinivas Nandkumar, Rockville; Kumar Swaminathan, North Potomac; Gaguk Zakaria, Hyattsville, all of MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/542,792

(22) Filed: Apr. 4, 2000

Related U.S. Application Data

(60) Provisional application No. 60/127,780, filed on Apr. 5, 1999.

(51) Int. Cl.[7] ..... G10L 19/04

(52) U.S. Cl. ..... 704/219; 704/220; 704/222; 704/225

(58) Field of Search ..... 704/219, 220, 704/221, 222, 223, 224, 225

(56) References Cited

U.S. PATENT DOCUMENTS

| | | | |
|---|---|---|---|
| 5,327,520 A | 7/1994 | Chen | 704/219 |
| 5,495,555 A | 2/1996 | Swaminathan | 704/207 |

(List continued on next page.)

OTHER PUBLICATIONS

WO 95/10760 A2, Ravishankar, Apr. 20, 1995, Fig. 1.
W. B. Kleijn and J. Haagan, "Waveform Interpolation for Coding and Synthesis", *Speech Coding and Synthesis*, 1995.

(List continued on next page.)

*Primary Examiner*—Marsha D. Banks-Harold
*Assistant Examiner*—Susan McFadden

(74) *Attorney, Agent, or Firm*—John T. Whelan; Michael W. Sales

(57) ABSTRACT

Encoding of prototype waveform components applicable to GeoMobile and Telephony Earth Station (TES) providing improved voice quality enabling a dual-channel mode of operation which permits more users to communicate over the same physical channel. A prototype word (PW) gain is vector quantized using a vector quantizer (VQ) that explicitly populates the codebook by representative steady state and transient vectors of PW gain for tracking the abrupt variations in speech levels during onsets and other non-stationary events, while maintaining the accuracy of the speech level during stationary conditions. The rapidly evolving waveform (REW) and slowly evolving waveform (SEW) component vectors are converted to magnitude-phase. The variable dimension SEW magnitude vector is quantized using a hierarchical approach, i.e., a fixed dimension SEW mean vector computed by a sub-band averaging of SEW magnitude spectrum, and only the REW magnitude is explicitly encoded. The REW magnitude vector sequence is normalized to unity RMS value, resulting in a REW magnitude shape vector and a REW gain vector. The normalized REW magnitude vectors are modeled by a multi-band sub-band model which converts the variable dimension REW magnitude shape vectors, e.g., six dimensional REW sub-band vectors. The sub-band vectors are averaged over time, resulting in a single average REW sub-band vector for each frame. At the decoder, the full-dimension REW magnitude shape vector is obtained from the REW sub-band vector by a piecewise-constant construction. The REW phase vector is regenerated at the decoder based on the received REW gain vector and the voicing measure, which determines a weighted mixture of SEW component and a random noise that is passed through a high pass filter to generate the REW component. The high pass filter poles are adjusted based on the voicing measure to control the REW component characteristics. At the output the filter, the magnitude of the REW component is scaled to match the received REW magnitude vector.

13 Claims, 7 Drawing Sheets

U.S. PATENT DOCUMENTS

| | | | | | |
|---|---|---|---|---|---|
| 5,517,595 | A | * | 5/1996 | Kleijn | 704/205 |
| 5,596,676 | A | * | 1/1997 | Swaminathan et al. | 704/208 |
| 5,839,102 | A | * | 11/1998 | Haagen et al. | 704/230 |
| 5,884,253 | A | * | 3/1999 | Kleijn | 704/223 |
| 5,903,866 | A | | 5/1999 | Shoham | 704/265 |
| 6,324,505 | B1 | * | 11/2001 | Choy et al. | 704/230 |
| 6,330,532 | B1 | * | 12/2001 | Manjunath et al. | 704/219 |

OTHER PUBLICATIONS

W. B. Kleijn, "Encoding Speech Using Prototype Waveforms", *IEEE Transactions on Speech and Audio Processing*, vol. 1, No. 4, pp. 386–399, 1993.

J. Hagen and W. B. Klejin, "Waveform Interpolation", *Modern Methods of Speech Processing* , 1995.

W. B. Kleijn, Y. Shoham, D. Sen and R. Hagen, "A Low Complexity Waveform Interpolation Coder", *IEEE International Conference on Acoustics, Speech and Signal Processing*, 1996.

Y. Shoham, "Very Low Complexity Interpolative Speech Coding at 1.2 to 2.4 kbps", *IEEE International Conference on Acoustics, Speech and Signal Processing*, 1997.

* cited by examiner

FREQUENCY DOMAIN INTERPOLATIVE SPEECH CODEC SYSTEM

CROSS-REFERENCE TO RELATED APPLICATION

This application is based upon and claims the benefit under 35 U.S.C. §119 of U.S. Provisional Application No. 60/127,780, filed Apr. 5, 1999, which is incorporated by reference.

BACKGROUND OF THE INVENTION

1. Field of the Invention

The present invention proposes novel techniques for modeling, quantization and error concealment of the evolving spectral characteristics of a representation of speech prediction residual signal, known as prototype waveform representation. This representation is characterized by a prototype waveform (PW) gain vector, a slowly evolving waveform (SEW) magnitude vector, SEW phase information, a rapidly evolving waveform (REW) gain vector, a REW magnitude shape vector and the REW phase model. These techniques are applicable to low bit rate speech coders operating in the range of 2–4 kbit/s. This invention proposes novel techniques for the quantization of the PW gain, the variable dimension SEW and REW magnitude vectors and for modeling the phases of SEW and REW components.

2. Background and Description of Related Art

The present invention describes techniques for efficient encoding of the speech signal applicable to speech coders typically operating at bit rates in the range of 2–4 kbit/s. In particular, such techniques are applicable to a representation of the speech prediction error (residual) signal known as the prototype waveform (PW) representation, see, e.g., W. B. Klejin and J. Haagen, "Waveform Interpolation for Coding and Synthesis", in Speech Coding and Synthesis, Edited by W. B. Klejin, K. K. Paliwal, Elsevier, 1995; W. B. Klejin, "Encoding Speech Using Prototype Waveforms", IEEE Transactions on Speech and Audio Processing, Vol. 1, No. 4, 386–399, 1993. The prototype waveforms are a sequence of complex Fourier transforms evaluated at pitch harmonic frequencies, for pitch period wide segments of the residual, at a series of points along the time axis. Thus, the PW sequence contains information about the spectral characteristics of the residual signal as well as the temporal evolution of these characteristics. A high quality of speech can be achieved at low coding rates by efficiently quantizing the important aspects of the PW sequence. In PW based coders, the PW is separated into a shape component and a level component by computing the RMS (or gain) value of the PW and normalizing the PW to unity RMS value. The normalized PW is decomposed into a slowly evolving waveform (SEW) which contains the periodic component of the residual and a rapidly evolving waveform (REW) which contains the aperiodic component of the residual. As the pitch frequency varies, the dimensions of the PW, SEW and REW vectors also vary, typically in the range 11–61.

This invention also proposes novel error concealment techniques for mitigating the effects of frame erasure or packet loss between the speech encoder and the speech decoder due to a degraded transmission medium.

W. B. Kiejin and J. Haagen, "Waveform Interpolation for Coding and Synthesis", in Speech Coding and Synthesis, Edited by W. B. Kiejin, K. K. Paliwal, Elsevier, 1995; W. B. Klejin, "Encoding Speech Using Prototype Waveforms", IEEE Transactions on Speech and Audio Processing, Vol. 1, No. 4, 386–399, 1993; and J. Hagen and W. B. Klejin, "Waveform Interpolation", in Modern Methods of Speech Processing, Edited by R. P. Ramachandran and R. Mammone, Kluwer Academic Publishers, 1995, describe the prototype waveform interpolation (PWI) modeling approach. However, the quantization of the PWI model is not specified in detail. The proposed invention pertains to the quantization of the various components of the PWI. The quantization approaches proposed in our invention are novel methods and are not in any way based on or derived from the quantization approaches described in the prior art in W. B. Klejin and J. Haagen, "Waveform Interpolation for Coding and Synthesis", in Speech Coding and Synthesis, Edited by W. B. Klejin, K. K. Paliwal, Elsevier, 1995; W. B. Klejin, "Encoding Speech Using Prototype Waveforms", IEEE Transactions on Speech and Audio Processing, Vol. 1, No. 4, 386–399, 1993; and J. Hagen and W. B. Klejin, "Waveform Interpolation", in Modern Methods of Speech Processing, Edited by R. P. Ramachandran and R. Mammone, Kluwer Academic Publishers, 1995. Additionally, W. B. Klejin, Y. Shoham, D. Sen and R. Hagen, "A Low Complexity Waveform Interpolation Coder", IEEE International Conference on Acoustics, Speech and Signal Processing, 1996, and Y. Shoham, "Very Low Complexity Interpolative Speech Coding at 1.2 to 2.4 kbps", IEEE International Conference on Acoustics, Speech and Signal Processing, 1997, describe certain quantization schemes for prototype waveform encoding.

In the prior art of W. B. Klejin and J. Haagen, "Waveform Interpolation for Coding and Synthesis", in Speech Coding and Synthesis, Edited by W. B. Kiejin, K. K. Paliwal, Elsevier, 1995, and W. B. Klejin, Y. Shoham, D. Sen and R. Hagen, "A Low Complexity Waveform Interpolation Coder", IEEE International Conference on Acoustics, Speech and Signal Processing, 1996, the PW gain vector is not quantized using a VQ designed by explicit population of steady state and transient codewords. This can result in poor performance during voicing onsets and other transitory events. The variable dimensionality of SEW and REW vectors is addressed by using fixed order analytical function approximations for the REW magnitude shape and by deriving the SEW magnitude approximately from the REW magnitude. The coefficients of the analytical function that provides the best fit to the vector are used to represent the vector for quantization. This approach suffers from three disadvantages: (i) A modeling error is now added to the quantization error, leading to a loss of performance, (ii) analytical function approximation for reasonable orders (5–10) deteriorates with increasing frequency, and (iii) if spectrally weighted distortion metrics are used during VQ, the complexity of these methods becomes formidable. In the prior art of W. B. Klejin and J. Haagen, "Waveform Interpolation for Coding and Synthesis", in Speech Coding and Synthesis, Edited by W. B. Klejin, K. K. Paliwal, Elsevier, 1995; and Y. Shoham, "Very Low Complexity Interpolative Speech Coding at 1.2 to 2.4 kbps", IEEE International Conference on Acoustics, Speech and Signal Processing, 1997, only a predetermined low frequency sub-band (for e.g., 0–800 Hz band) of the SEW magnitude is encoded. This substantially reduces the dimension of the SEW vector, thereby permitting direct VQ. At the receiver, the remaining upper band is estimated using the REW magnitude spectrum. This method suffers from the disadvantage that if a significant amount of signal energy exists in the upper band, it is reproduced poorly, leading to poor speech quality. This condition can occur for a number of speech sounds, especially for unvoiced speech.

A number of prior techniques for encoding phase are in use in PWI based voice coders, e.g., W. B. Kiejin and J. Haagen, "Waveform Interpolation for Coding and Synthesis", in Speech Coding and Synthesis, Edited by W. B. Klejin, K. K. Paliwal, Elsevier, 1995; W. B. Klejin, "Encoding Speech Using Prototype Waveforms", IEEE Transactions on Speech and Audio Processing, Vol. 1, No. 4, 386–399, 1993; W. B. Klejin, Y. Shoham, D. Sen and R. Hagen, "A Low Complexity Waveform Interpolation Coder", IEEE International Conference on Acoustics, Speech and Signal Processing, 1996; J. Hagen and W. B. Klejin, "Waveform Interpolation", in Modern Methods of Speech Processing, Edited by R. P. Ramachandran and R. Mammone, Kluwer Academic Publishers, 1995; Y. Shoham, "Very Low Complexity Interpolative Speech Coding at 1.2 to 2.4 kbps", IEEE International Conference on Acoustics, Speech and Signal Processing, 1997. In these prior art, the SEW phase vector is either a random phase (for unvoiced sounds) or is the phase of a fixed pitch cycle waveform (for voiced sounds). This binary characterization of the SEW phase is too simplistic. This method may work for a narrow range of speakers and for clean speech signals. However, this method becomes unsatisfactory as the range of speakers increases and for speech corrupted by background noise. Noisy speech requires varying degrees of randomness in the SEW phase.

In prior art of W. B. Klejin and J. Haagen, "Waveform Interpolation for Coding and Synthesis", in Speech Coding and Synthesis, Edited by W. B. Klejin, K. K. Paliwal, Elsevier, 1995; W. B. Klejin, "Encoding Speech Using Prototype Waveforms", IEEE Transactions on Speech and Audio Processing, Vol. 1, No. 4, 386–399, 1993; W. B. Klejin, Y. Shoham, D. Sen and R. Hagen, "A Low Complexity Waveform Interpolation Coder", IEEE International Conference on Acoustics, Speech and Signal Processing, 1996, the REW quantization does not employ a normalization of the REW magnitude vectors, whereby the level and shape information are separated. Instead, the REW magnitude vectors are quantized directly. The separation of level and shape, as proposed in this invention, is advantageous, since it allows more accurate quantization of time varying REW level, which is of primary importance. Secondly, in the prior art cited above, REW magnitude quantization is based upon the use of analytical functions to overcome the problem of variable dimensionality. This approach suffers from three disadvantages as mentioned earlier: (i) A modeling error is now added to the quantization error, leading to a loss of performance, (ii) analytical function approximation for reasonable orders (5–10) deteriorates with increasing frequency, and (iii) if spectrally weighted distortion metrics are used during VQ, the complexity of these methods becomes formidable.

In the prior art of W. B. Klejin and J. Haagen, "Waveform Interpolation for Coding and Synthesis", in Speech Coding and Synthesis, Edited by W. B. Klejin, K. K. Paliwal, Elsevier, 1995, and W. B. Klejin, Y. Shoham, D. Sen and R. Hagen, "A Low Complexity Waveform Interpolation Coder", IEEE International Conference on Acoustics, Speech and Signal Processing, 1996, REW phase is obtained at the receiver using random phase models. Use of a random phase for REW results in reconstructed speech that is excessively rough. This is due to the fact that it is not consistent with the SEW-REW separation model that is employed at the encoder. Consequently, the random phase model results in a REW component that does not conform to certain basic characteristics of the REW at the encoder. As an example, it is possible for the random phase based REW to have a significant amount of energy below 25 Hz, which is not possible for the REW at the encoder. Further, the correlation between SEW and REW due to the overlapping separation filters cannot be directly created when a random phase model is employed.

None of the prior art related to PW speech coders address the issue of error concealment that can be applied to the PW model parameters.

SUMMARY OF THE INVENTION

This invention proposes novel techniques for the modeling, quantization and error concealment, applicable to the components of a PW based voice coder, i.e., the PW gain vector and the variable dimension SEW and REW complex vectors. The prototype waveform (PW) gain is vector quantized using a vector quantizer (VQ) that explicitly populates the codebook by representative steady state and transient vectors of PW gain. This approach is effective in tracking the abrupt variations in speech levels during onsets and other non-stationary events, while maintaining the accuracy of the speech level during stationary conditions. In case of a frame erasure, errors in the PW gain parameter are concealed by estimating the PW gain based on the PW gains of the two preceding error-free frames and gradually decaying this estimate over the duration of the current Same.

The rapidly evolving waveform (REW) and slowly evolving waveform (SEW) component vectors are converted to magnitude-phase formats for quantization. The variable dimension SEW magnitude vector is quantized using a hierarchical approach. A fixed dimension SEW mean vector is computed by a sub-band averaging of SEW magnitude spectrum. A SEW deviation vector is computed by subtracting the SEW mean from the SEW magnitude vector. The variable dimension SEW deviation vector is reduced to a fixed dimension subvector of size 10, based on a dynamic frequency selection approach. The SEW deviation subvector and SEW mean vector are vector quantized using a switched predictive VQ. At the decoder, the SEW deviation subvector and the SEW mean vector are combined to construct a full dimension SEW magnitude vector. This hierarchical approach to SEW magnitude quantization emphasizes the accurate representation of the average SEW magnitude level, which is perceptually important. Additionally, the average level gets refined at frequencies that are perceptually significant. In case of a frame erasure, errors in the SEW magnitude are concealed by estimating it using the preceding error-free SEW mean vector.

SEW phase information is represented implicitly using a measure of the degree of periodicity of the residual signal. This voicing measure is computed using a weighted root mean square (RMS) value of the SEW, a measure of the variance of SEW and the peak value of the normalized autocorrelation function of the residual signal and is quantized using 3 bits. At the decoder, the SEW phase is computed by a weighted combination of the previous SEW phase vector, a random phase perturbation and a fixed phase vector obtained from a voiced pitch pulse. The relative weights for these components are determined by the quantized voicing measure and the ratio of SEW and REW RMS values. The decoded SEW magnitude and SEW phase are combined to produce a complex SEW vector. The SEW component is passed through a low pass filter to reduce excessive variations and to be consistent with the SEW extraction process at the encoder. The SEW magnitude is preserved after the filtering operation. In case of a frame erasure, the voicing measure is estimated using a voice activity detector (VAD) output and the RMS value of the decoded SEW magnitude vector.

The REW magnitude vector sequence is normalized to unity RMS value, resulting in a REW magnitude shape vector and a REW gain vector. The normalized REW magnitude vectors are modeled by a multi-band sub-band model which converts the variable dimension REW magnitude shape vectors to a fixed dimension, e.g., to five dimensional REW sub-band vectors in the described embodiment. The sub-band vectors are averaged over time, resulting in a single average REW sub-band vector for each frame. At the decoder, the full-dimension REW magnitude shape vector is obtained from the REW sub-band vector by a piecewise-constant interpolation.

The REW gain vector is estimated using the quantized SEW mean vector. The resulting estimation error has a smaller variance and is efficiently vector quantized. A 5-bit vector quantization is used to encode the estimation error. In case of a frame erasure, the estimate provided by the SEW mean is used as the REW magnitude.

The REW phase vector is regenerated at the decoder based on the received REW gain vector and the voicing measure, which determines a weighted mixture of SEW component and a random noise that is passed through a high pass filter to generate the REW component. The weighting is adjusted so as to achieve the desired degree of correlation between the REW and the SEW components. The high pass filter poles are adjusted based on the voicing measure to control the REW component characteristics. At the output the filter, the magnitude of the REW component is scaled to match the received REW magnitude vector.

In addition to the error concealment techniques for the PW parameters, this invention also proposes error concealment and recovery techniques for the speech line spectral frequency (LSF) parameters and the pitch period parameter. In the case of a frame error, the LSF's are constructed using the previous error-free LSF vector. During the error recovery process, the LSF's are forced to change smoothly. In the case of pitch period, frame errors are concealed by repeating the preceding error-free pitch period value. Further, during error recovery, the pitch contour is forced to conform to certain smoothness conditions.

The invention uses a PW gain VQ design that explicitly populates a partitioned codebook using representative steady state and transient vectors of PW gain, e.g., 75% of the codebook is allocated to representing steady state vectors and the remaining 25% is allocated to representation of transient vectors. This approach allows better tracking of the variations of the residual power levels. This is particularly important at speech onsets during which the speech power levels can change by several orders of magnitude within a 20 ms frame. On the other hand, during steady state frames, the speech power level variation is significantly smaller. Other approaches, see, e.g., W. B. Klejin and J. Haagen, "Waveform Interpolation for Coding and Synthesis", in Speech Coding and Synthesis, Edited by W. B. Klejin, K. K. Paliwal, Elsevier, 1995; W. B. Klejin, "Encoding Speech Using Prototype Waveforms", IEEE Transactions on Speech and Audio Processing, Vol, 1, No. 4, 386–399, 1993; W. B. Klejin, Y. Shoham, D. Sen and R. Hagen, "A Low Complexity Waveform Interpolation Coder", IEEE International Conference on Acoustics, Speech and Signal Processing, 1996; J. Hagen and W. B. Klejin, "Waveform Interpolation", in Modern Methods of Speech Processing, Edited by R. P. Ramachandran and R. Mammone, Kluwer Academic Publishers, 1995 Y. Shoham, "Very Low Complexity Interpolative Speech Coding at 1.2 to 2.4 kbps", IEEE International Conference on Acoustics, Speech and Signal Processing, 1997, speech gain vectors are not quantized using such a partitioned VQ approach. Consequently, the codebook will be dominated by steady state vectors, and may lead to poor reproduction of speech levels during onsets.

The SEW vector determines the characteristics of the voiced segments of speech, and hence is perceptually important. It is quantized in magnitude-phase form. It is important to maintain the correct average level (across frequency) of the SEW magnitude vector. The variation about this average is of secondary importance compared to the average itself. Motivated by this consideration, the present invention uses a hierarchical approach to representing the SEW magnitude vector as the sum of a SEW mean vector and a SEW deviation vector. The SEW mean vector is obtained by a sub-band averaging process, resulting in a 5-dimensional vector. The SEW deviation vector is the difference between the SEW magnitude vector and the SEW mean vector. Compared to the SEW deviation vector, SEW mean vector is quantized more precisely and better protected against channel errors. This hierarchical decomposition into a mean component and a deviation component had the important advantage that the average SEW levels can be preserved better. This is very important in achieving a high-perceived quality of speech, especially during voiced segments. Prior techniques, see, e.g., W. B. Klejin and J. Haagen, "Waveform Interpolation for Coding and Synthesis", in Speech Coding and Synthesis, Edited by W. B. Klejin, K. K. Paliwal, Elsevier, 1995; W. B. Kiejin, "Encoding Speech Using Prototype Waveforms", IEEE Transactions on Speech and Audio Processing, Vol. 1, No. 4, 386–399, 1993; W. B. Klejin, Y. Shoham, D. Sen and R. Hagen, "A Low Complexity Waveform Interpolation Coder", IEEE International Conference on Acoustics, Speech and Signal Processing, 1996; J. Hagen and W. B. Kiejin, "Waveform Interpolation", in Modern Methods of Speech Processing, Edited by R. P. Ramachandran and R. Mammone, Kluwer Academic Publishers, 1995; Y. Shoham, "Very Low Complexity Interpolative Speech Coding at 1.2 to 2.4 kbps", IEEE International Conference on Acoustics, Speech and Signal Processing, 1997, have employed non-hierarchical approaches and are likely to result in lower performance and less robustness to channel errors.

The dimension of the REW and SEW vectors is a variable that depends upon the pitch frequency, and typically varies in the range 11–61. Existing VQ techniques, such as direct VQ, split VQ and multi-stage VQ are not well suited for variable dimension vectors. Adaptations of these techniques for variable dimension is neither practical from an implementation viewpoint nor satisfactory from a performance viewpoint. These are not practical since the worst case high dimensionality results in a high computational cost and a high storage cost. This usually leads to simplifications such as structured VQ, which result in a loss of performance, making such solutions unsatisfactory for encoding speech at bit rates in the range 2–4 kbit/s.

In a prior technique to address the variable dimensionality problem, W. B. Klejin, V. Shoham, D. Sen and R. Hagen, "A Low Complexity Waveform Interpolation Coder", IEEE International Conference on Acoustics, Speech and Signal Processing, 1996, analytical functions of a fixed order are used to approximate the variable dimension vectors. The coefficients of the analytical function that provides the best fit to the vectors are used to represent the vectors for quantization. The analytical function approximation is applied to the REW magnitude. The SEW magnitude is derived approximately from the REW magnitude in the 800 Hz–4000 Hz band. The SEW magnitude is explicitly coded only in the 0–800 Hz band. This approach suffers from three disadvantages: (i) A modeling error is now added to the quantization error, leading to a loss of performance, (ii) analytical function approximation for reasonable orders (5–10) deteriorates with increasing frequency, and (iii) if spectrally weighted distortion metrics are used during VQ, the complexity of these methods becomes formidable.

This invention proposes a novel solution to this problem which has a reasonable computation and storage cost, and at the same time provides a high level of performance. In this approach, the variable dimension SEW vector is decomposed into two fixed dimension vectors in a hierarchical manner, as the sum of a SEW mean vector and a SEW deviations vector. The SEW mean vector is obtained by a 5-band sub-band averaging and is represented by a 5-dimensional vector. The SEW deviations vector is reduced to a SEW deviation sub-vector of fixed dimension of 10 by selecting the 10 elements that are considered most important for speech quality. The set of selected frequencies varies with the spectral characteristics of speech, but is done in such a way that it needs no explicit transmission. In the absence of channel errors, the decoder can map the SEW deviation sub-vectors to the correct frequencies. The unselected elements of the SEW deviations are not encoded. The full-dimension SEW magnitude vector is reconstructed at the decoder by adding the quantized SEW mean and the SEW deviation components.

During voiced segments, the SEW magnitude vector exhibits a certain degree of interframe correlation. In order to exploit thig property, the SEW mean vector is quantized using a switched predictive VQ. The SEW deviation sub-vector is quantized using a switched predictive gain-shape quantization. The predictor mode for SEW mean vector and the SEW deviations vector are jointly switched so as to minimize a spectrally weighted distortion between the reconstructed and the original SEW magnitude vectors. At the decoder, the SEW deviation sub-vector and the SEW mean vector are combined to produce the full dimension SEW magnitude vector.

Direct encoding of the SEW phase vector leads to unsatisfactory results when a small number of bits are employed. The present invention overcomes this problem by implicitly representing SEW phase using a measure of periodicity called the voicing measure. The voicing measure is computed using a weighted RMS value of the SEW, a measure of variability of SEW and the peak value of the normalized autocorrelation of the residual signal. The voicing measure is also useful in REW phase modeling. The voicing measure is quantized using 3 bits. At the decoder, the SEW phase is computed by a weighted combination of the previous SEW phase vector, a random phase perturbation and a fixed phase vector which corresponds to a voiced pitch pulse. The relative weights for these components are determined by the quantized voicing measure. The decoded SEW magnitude and SEW phase are combined to produce the complex SEW vector. The SEW component is filtered using a low pass filter to suppress excessively rapid variations that can appear due to the random component in SEW phase. The strength of the proposed technique is that it can realize various degrees of voicing in a frequency dependent manner. This results in more natural sounding speech with the right balance of periodicity and roughness both under quiet and noisy ambient conditions.

The REW magnitude vector sequence is normalized to unity RMS value, resulting in a REW magnitude shape vector and a REW gain vector. This separates the more important REW level information from the relatively less important REW shape information. Encoding of the REW gain vector serves to track the level of the REW magnitude vector as it varies across the frame. This is important to maintain the correct level of roughness as well as evolution bandwidth (temporal variation) of the random component in the reconstructed speech. The REW gain vector can be closely estimated using the encoded SEW mean vector. Consequently, REW gain is efficiently encoded by quantizing the REW gain estimation error with a small number of bits.

Prior techniques W. B. Kiejin, Y. Shoham, D. Sen and R. Hagen, "A Low Complexity Waveform Interpolation Coder", IEEE International Conference on Acoustics, Speech and Signal Processing, 1996; Y. Shoham, "Very Low Complexity Interpolative Speech Coding at 1.2 to 2.4 kbps", IEEE International Conference on Acoustics, Speech and Signal Processing, 1997 did not employ a gain-shape decomposition of REW magnitude or an estimation of REW gain vector using SEW level information. The separation of level and shape is advantageous, since it allows more accurate quantization of time varying REW level, which is of primary importance. Estimation using SEW level improves quantization accuracy. In prior techniques, the entire REW magnitude was modeled using analytical functions. This approach has serious shortcomings as mentioned earlier.

The normalized REW magnitude vectors are variable dimension vectors. To convert to a fixed dimension representation, these are modeled by a 6-band sub-band model resulting in 6 dimensional REW sub-band vectors. The REW sub-band vectors are averaged across the frame to obtain a single average REW sub-band vector for each frame. The average REW sub-band vector is vector quantized. At the decoder, the full-dimension REW magnitude shape vector is obtained from the REW sub-band vector by a piecewise-constant construction. Prior REW magnitude quantization is based upon the use of analytical functions to overcome the problem of variable dimensionality, W. B. Klejin, Y. Shoham, D. Sen and R. Hagen, "A Low Complexity Waveform Interpolation Coder", IEEE International Conference on Acoustics, Speech and Signal Processing, 1996. This approach suffers from the disadvantages discussed earlier.

The REW phase vector is not explicitly encoded. At the receiver, the complex REW vector is derived using the received REW gain vector, received voicing measure and the received SEW vector. The complex REW component is derived by filtering a weighted sum of the complex SEW component and a white noise signal through a high pass filter. The weighting of SEW and white noise is dependent on the average REW gain value for that frame. The high pass filter is a single-zero, two-pole filter, whose real zero is adjusted based on SEW and REW levels. The complex pole frequency is fixed at 25 Hz (assuming a 50 Hz SEW sampling rate). The pole radius varies from 0.2 to 0.60, depending on the decoded voicing measure. As the periodicity of the frame increases (as indicated by a lower voicing measure), the pole moves closer to the unit circle. At the same time, at the filter input, the weight of the SEW component increases relative to that of the white noise component. This has the effect of creating a REW component having more correlation with SEW and with more of its energy at lower frequencies. At the same time, the presence of the zero at 0.9 ensures that the REW energy diminishes below 25 Hz, The overall result is to create a REW component that has its energy distributed in a manner roughly consistent with the REW extraction process at the encoder and with the relative levels of REW and SEW components.

In prior implementations of PWI coding W. B. Klejin, Y. Shoham, D. Sen and R. Hagen, "A Low Complexity Waveform Interpolation Coder", IEEE International Conference on Acoustics, Speech and Signal Processing, 1996; V. Shoham, "Very Low Complexity Interpolative Speech Coding at 1.2 to 2.4 kbps", IEEE International Conference on Acoustics, Speech and Signal Processing, 1997, REW phase was obtained at the receiver using random phase models. Use of a random phase for REW results in reconstructed speech that is excessively rough. This is due to the fact that it is not consistent with the SEW-REW separation model that is employed at the encoder. Consequently, the random phase model results in a REW component that does not conform to certain basic characteristics of the REW at the encoder. As an example, the random phase based REW is likely to have a significant amount of energy below 25 Hz, while the REW at encoder does not have a significant amount of energy below 25 Hz. Further, the correlation between SEW and REW due to the overlapping separation filters cannot be directly created when a random phase model is employed.

DETAILED DESCRIPTION OF THE PREFERRED EMBODIMENTS

Figure 1:
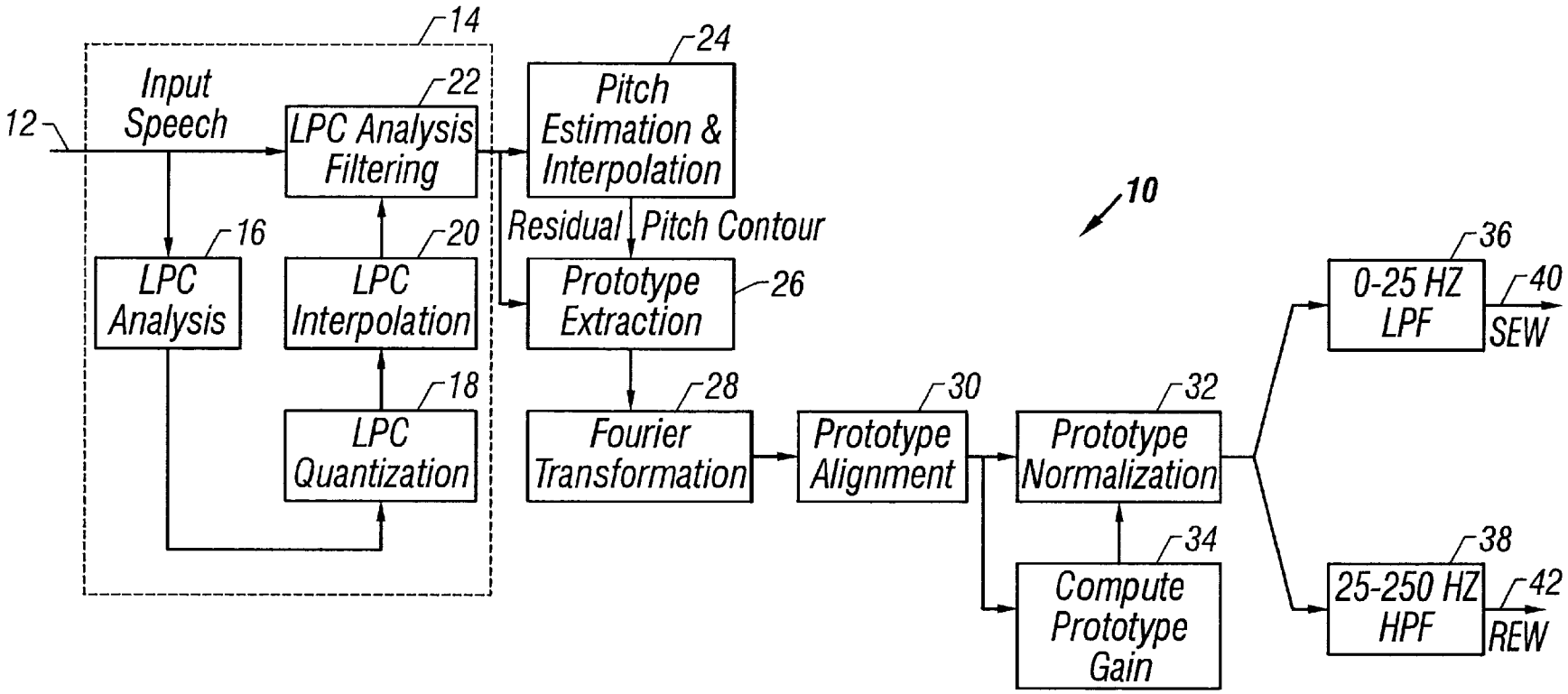
FIG. 1 is a schematic block diagram illustrating the computation of prototype waveforms and extraction of slowly and rapidly evolving waveforms.

In low rate coding of speech signals, it is common to employ linear predictive coding (LPC) or some other equivalent technique to model the short-term spectra of the speech signal. The corrections to the short term spectral model of speech as well as the glottal excitation to the vocal tract are embodied in a prediction error (residual) signal, obtained by filtering the speech signal by an all-zero LPC filter. Hence, in order to reproduce natural sounding speech at the decoder, it is essential to encode the residual signal in such a way that the perceptually important aspects of the residual signal can be reproduced. This invention pertains to a set of methods for efficient encoding of the residual signal for voice coders operating at bit rates in the range of 2–4 kbit/s.

In particular, this invention is applicable to a paradigm of speech signal representation known as prototype waveform interpolation (PWI). W. B. Klejin and J. Haagen, "Waveform Interpolation for Coding and Synthesis", in Speech Coding and Synthesis, Edited by W. B. Klejin, K. K. Paliwal, Elsevier, 1995; W. B. Klejin and J. Haagen, "Waveform Interpolation for Coding and Synthesis", in Speech Coding and Synthesis, Edited by W. B. Klejin, K. K. Paliwal, Elsevier, 1995. In this paradigm, the perceptually important aspects of the residual signal are represented as temporally evolving spectral characteristics. Specifically, the residual signal is represented by a sequence of prototype waveform (PW) vectors, which contains the time varying spectral characteristics of the residual. The PW vectors are derived by evaluating the complex Fourier transform of residual pitch cycles at the pitch frequency harmonics at a sequence of time instances. The PW is in turn separated into two components: a slowly evolving waveform (SEW) corresponding to the periodic component of the residual and a rapidly evolving waveform (REW) corresponding to the aperiodic component of the residual. For a detailed description of the PWI modeling process and the separation of SEW and REW, see W. B. Klejin and J. Haagen, "Waveform Interpolation for Coding and Synthesis", in Speech Coding and Synthesis, Edited by W. B. Klejin, K. K. Paliwal, Elsevier, 1995; W. B. Kejin and J. Haagen, "Waveform Interpolation for Coding and Synthesis", in Speech Coding and Synthesis, Edited by W. B. Klejin, K. K. Paliwal, Elsevier, 1995. The discussion in this invention will focus on the methods of quantizing the SEW, REW and PW gain components.

The PW gain is vector quantized by an 8-bit vector quantizer (VQ). The VQ is designed using an approach that explicitly populates the codebook by representative steady state and transient vectors of PW gain. 75% of the codebook is allocated to representing steady state vectors and the remaining 25% is allocated to representation of transient vectors. This approach is better able to track the abrupt variations in speech levels during onsets and other non-stationary events, while maintaining the accuracy of the speech level during stationary conditions.

The complex SEW vector is quantized in the magnitude-phase form. The variable dimension SEW magnitude vector is quantized using a hierarchical approach, using fixed dimension VQ. A 5-dimension SEW mean vector is computed by a sub-band averaging of SEW magnitude spectrum. A SEW deviation vector is computed by subtracting the SEW mean from the SEW magnitude vector. The variable dimension SEW deviation vector is reduced to a fixed dimension sub-vector of size 10, based on a dynamic frequency selection approach which uses the short term spectral characteristics of speech. The selection is done in such a way that explicit transmission of the frequencies of the selected coefficients is not required. The SEW deviation sub-vector and SEW mean vector are vector quantized. Both these vector quantizations are switched predictive, with the predictor mode being selected jointly so as to minimize a spectrally weighted distortion measure relative to the original SEW magnitude vector. At the decoder, the SEW deviation sub-vector and the SEW mean vector are combined to construct a full dimension SEW magnitude vector. This hierarchical approach to SEW magnitude quantization emphasizes the accurate representation of the average SEW magnitude level, which is perceptually important. Additionally, corrections to the average level are made at frequencies that are perceptually significant. This method also solves the difficult problem of quantizing variable dimension vectors in an effective and efficient manner.

The SEW phase information is represented implicitly using a measure of the degree of periodicity of the residual signal. This voicing measure is computed using a weighted root mean square (RMS) value of the SEW, a measure of the variance of SEW and the peak value of the normalized autocorrelation function of the residual signal. The voicing measure is quantized using 3 bits. At the decoder, the SEW phase is computed by a weighted combination of the previous SEW phase vector, a random phase perturbation and a fixed phase vector obtained from a voiced pitch pulse. The relative weights for these components are determined by the quantized voicing measure. The decoded SEW magnitude and SEW phase are combined to produce a complex SEW vector.

The REW vector is converted to magnitude-phase form, and only the REW magnitude is explicitly encoded. The REW magnitude vector sequence is normalized to unity RMS value, resulting in a REW magnitude shape vector and a REW gain vector. The normalized REW magnitude vectors are modeled by a 5-band sub-band model. This converts the variable dimension REW magnitude shape vectors to 5 dimensional REW sub-band vectors. These sub-band vectors are averaged across the time, resulting in a single average REW sub-band vector for each frame. This average REW sub-band vector is vector quantized. At the decoder, the full-dimension REW magnitude shape vector is obtained from the REW sub-band vector by a piecewise-constant construction.

The quantized SEW mean vector can be used to obtain a good estimate the REW gain vector. The resulting estimation error has a smaller variance and is efficiently vector quantized. A 5-bit vector quantization is used to encode the estimation error.

The PXW phase vector is regenerated at the decoder based on the a received REW gain vector and the voicing measure. These determine a weighted mixture of SEW component and a random noise, which is passed through a high pass filter to generate the REW component. The high pass filter poles are adjusted based on the voicing measure to control the REW component characteristics. The high pass filter zero is adjusted based on SEW and REW levels. At the output of the filter, the magnitude of the REW component is scaled to match the received REW magnitude vector.

The SEW corresponds to the quasi-periodic component of the residual. This is a perceptually important component and hence it should be quantized precisely. However, since it varies slowly, it can be transmitted less frequently (typically once/20 ms). The REW component corresponds to the random component in the residual. This is perceptually less important than the SEW, and hence can be quantized coarsely. But since the REW varies more rapidly, and it should be transmitted more frequently than the SEW (typically once/2 ms).

The frequency domain interpolative codec design provides a linear prediction (LP) front end whose parameters are quantized and encoded at 20 ms intervals, using the LSF domain using multi-stage VQ with backward prediction. Voice Activity Detection (VAD) with single bit transmission and decoding is used. Open loop pitch extraction is performed at 20 ms intervals and quantized using a scalar quantizer. PW extraction, gain computation, and normalization are performed every 2 ms. Separation of the normalized PW into SEW and REW uses complimentary 21 tap linear phase low-pass and high-pass FIR filters.

The PW gain is low pass filtered and decimated by a 2:1 ratio to produce a smoothed or filtered PW gain for a 5 dimensional VQ. The 5 dimensional VQ has two distinct sections, i.e., a section allocated to representing steady "state vectors," and a section allocated to representation of "transient vectors." This approach is better able to track the abrupt variations in speech levels during onsets and other non-stationary events, while maintaining the accuracy of the speech level during stationary conditions. Error concealment for the PW gain parameter is carried out by decaying an average measure of PW gain obtained from the last two frames. For subsequent bad frames, the rate of decay is increased. The error recovery limits the received PW gain growth to within an adaptive bound in the first good frame.

The quantization of the SEW magnitude uses a mean-RMS-shape method with switched backward prediction and a voicing dependent SEW mean codebook. A voicing measure that characterizes the degree of voicing is derived as the output of a neural network using several input parameters that are correlated to the degree of periodicity of the signal. The SEW phase model uses the pitch frequency contour and the voicing measure in every 20 ms frame to generate the SEW phase as a weighted combination of a fixed phase, the previous SEW phase and a random phase component. The resulting complex SEW signal is low pass filtered to control its evolutionary rate.

The quantization of the REW magnitude uses a gain-shape approach. The REW phase model determines REW phase as the phase of the output of an adaptive second order pole-zero filter which is driven by a weighted combination of SEW and noise with random phase but a normalized energy level with respect to the SEW RMS value. Error concealment and recovery methods use the interdependency and residual redundancies of the various PW parameters, and adaptive post-processing techniques further enhance the voice quality of the synthesized speech.

Adaptive bandwidth broadening is employed for post-processing inactive speech frames to mitigate annoying artifacts due to spurious spectral peaks by (1) computing a measure of VAD likelihood by summing the VAD flags for the preceding the current and the next two frames (which are available due to the 2 frame look-ahead employed at the encoder), and (2) using the VAD likelihood measure and voicing measure to determine the degree of bandwidth broadening necessary for the interpolated LP synthesis filter coefficients. The VAD likelihood measure error concealment relies on setting the VAD flag for the most recently received frame as 1 thus introducing a bias towards active speech and reducing the possibility or degree of adaptive bandwidth broadening. The error concealment for the LSF's involves discarding the received error vector and using a higher value of the fixed predictor coefficient. The error recovery involves reconstructing the current as well as the previous set of LSF's in such a way that they evolve in the smoothest possible manner, i.e., the previous set is the average of the current LSF's and LSF's two frames ago. The open loop pitch parameter error concealment involves repetition of the previous pitch period and its recovery involves either repetition or averaging to obtain the previous pitch period depending on the number of consecutive bad frames that have elapsed.

A schematic block diagram illustrating the computation of the PW, SEW and REW components is presented in FIG. 1. FIG. 1 is a schematic block diagram illustrating the computation of prototype waveforms and extraction of slowly and rapidly evolving waveforms SEW and REW from an input speech signal 12 presented to a linear predictive filter 14 responsive to input signals for identifying prototype waveforms over pitch period intervals. The linear predictive filter includes LPC analysis 16, LPC quantization 18, LPC interpolation 20, and LPC analysis filtering 22 which provides filtered and residual signals to pitch estimation and interpolation 24 and prototype extraction at block 26 from residual and pitch contour signals. Spectral analysis is performed with Fourier transformation 28 and prototype alignment at block 30 aligns the segments of the pitch cycles prior to prototype normalization 32 and prototype gain computation 34. A spectral analyzer, e.g., a low pass filter (LPF) 36, is provided for extracting the SEW waveform 40, herein frequencies from 0 to 25 Hz. Additionally, a high pass spectral analyzer 38, e.g., a high pass filter (HPF), may be used to extract the REW waveform 42, herein frequencies ranging between 25 and 250 Hz are provided for the REW 42.

The input speech signal is processed in consecutive non-overlapping blocks of N samples called frames. Let $\{s(n), 0 \leqq n < N\}$ denote the current speech frame, i.e., the block of speech samples that is currently being encoded. In order to compute the SEW and REW corresponding to this speech data, it is necessary to "look-ahead" for the next 2 speech frames, i.e., buffer the frames $\{s(n), N \leqq n < 2N\}$ and $\{s(n), 2N \leqq n < 3N\}$. An $L^{th}$ order autocorrelation LPC analysis is carried out for the data $\{s(n), N \leqq n < 3N\}$ using a 2N point Hamming window, resulting in a set of LPC parameters representing the speech power spectral density (PSD) around the point n=2N. The LPC parameters are quantized using a multi-stage LSF vector quantization P. LeBlanc, B. Bhattacharya, S. A. Mahmoud, V. Cuperman, "Efficient Search and Design Procedures for Robust Multi-Stage VQ of LPC Parameters for 4 kbit/s Speech Coding", IEEE Transactions on Speech and Audio Processing, Vol. 1, No. 4, October 1993. The resulting quantized LPC parameters will be denoted by $\{a_1(2N), 0 \leqq l \leqq L\}$, with $a_0(2N)=1$. A pitch analysis is also performed using the data in $\{s(n), 2N \leqq n < 3N\}$, resulting in a pitch frequency estimate for n=2N, which will be denoted by $w_p$ (2N) and expressed in radians/sample. A voice activity detector determines the presence or absence of speech activity for the frame $\{s(n), 2N \leqq n < 3N\}$. This information is denoted by $v_f$ is encoded using 1 bit and transmitted to the decoder. Presence of voice activity is encoded as a 1 and the absence of voice activity is encoded as a 0.

Each frame is subdivided into M subframes of length $N_s$ such that $N_s M = N$. In a typical realization, the number of samples per frame is N=160, corresponding to a frame size of 20 ms (at 8 kHz sampling rate), and the number of samples per subframe is $N_s=16$, corresponding to a subframe size of 2 ms and M=10 subframes per frame. A typical value for the LPC analysis order is L=10. The pitch period is allowed to vary within the range of 20–120 samples. For generality, the following discussion will continue to use symbolic notations for these parameters, unless numerical values are needed for clarification.

The LPC parameters are interpolated within each frame to obtain a set of interpolated LPC parameters for every subframe. This interpolation is performed linearly in the LSF domain and the resulting LPC parameters for the frame $N \leqq n < 2N$ are denoted by $\{a_l(m), 0 \leqq l \leqq L, M \leqq m < 2M\}$. The pitch frequency is linearly interpolated for every sample within the frame, resulting in a pitch contour $\{w_p(n), N \leqq n < 2N\}$ for the frame $N \leqq n < 2N$. Finally, the interpolated LPC parameters and pitch contour are preserved for the current frame $0 \leqq n < N$, such that $\{a_l(m), 0 \leqq l \leqq L, 0 \leqq m < M\}$ and $\{w_p(n), 0 \leqq n < N\}$ are also available.

For the $m^{th}$ subframe in the frame $N \leqq n < 2N$, the prediction residual signal is computed using the interpolated LPC parameters as follows:

$$e'_m(n) = \sum_{l=0}^{L} a_l(M+m)x(N+mN_s+n-1), \qquad 9.2.1$$

$$-0.5p(M+m)-10 \leqq n < 0.5p(M+m)+10$$

Here, p(M+m) is the pitch period for the $m^{th}$ subframe in the next frame, given by $$p(M+m) = \left[\frac{2\pi}{w_p(N+mN_s)}\right] \qquad 9.2.2$$

where [ ] indicates the rounding operation, so that p(M+m) is integer valued. From (9.2.1), it is evident that the length of the residual signal exceeds the pitch period p(M+m). So a segment of length p(M+m) can be extracted from $\{e'_m(n)\}$ such that the segment boundaries occur at relatively low energy regions of the residual signal. If this segment is denoted by $\{e_m(n), 0 \leqq n < p(M+m)\}$, the prototype waveform for the $m^{th}$ subframe is computed by evaluating the Fourier transform of $\{e_m(n)\}$ at the pitch harmonic frequencies $\{kw_{p(N+mNs)}), 0 \leqq k \leqq K(M+m)\}$:

$$P'(M+m, k) = \sum_{n=0}^{p(M+m)-1} e_m(n)e^{-jkw_p(N+mN_s)n} \qquad 9.2.3$$

$$0 < m \leqq M,\ 0 \leqq k \leqq K(M+m).$$

Here K(M+m) is the harmonic index of the highest frequency pitch harmonic that can be contained within the frequency band of the signal. K(M+m) is given by $$K(M+m) = \left\lfloor \frac{\pi}{w_p(N+mN_s)} \right\rfloor, \qquad 9.2.4$$

where, $\lfloor x \rfloor$ denotes the largest integer less than or equal to x. Each new PW vector is phase-aligned with the preceding PW vector in the sequence, by removing a linear phase component from the new PW vector to maximize its correlation to the preceding (phase-aligned) PW vector, Let $\{P''(M+m, k)\}$ denote the aligned version of the PW vector sequence. A PW gain is computed for each subframe by $$G_{pw}(M+m) = \frac{1}{(2K(M+m)+2)} \sum_{k=0}^{K(M+m)} |P''(M+m, k)|^2 \qquad 9.2.5$$

$$0 < m \leqq M.$$

The aligned PW vectors are normalized by the PW gains, leading to an aligned and normalized PW vector sequence:

$$P(M+m, k) = \frac{P''(M+m, k)}{G_{pw}(M+m)} \quad 0 \le k \le K(M+m), \qquad 9.2.6$$

$$0 < m \leqq M.$$

The alignment and normalization operations ensure that each harmonic of the PW sequence evolves smoothly along the time axis. At a subframe size of 2 ms, the sampling rate of PW is 500 Hz and its evolutionary bandwidth is limited to 250 Hz. The SEW is defined as the component of the PW that occupies the 0–25 Hz band and the REW is defined as the component that occupies the 25–250 Hz band. The SEW can be separated by low-pass filtering (LPF) each harmonic of the PW, using a 21-tap linear phase FIR filter with a nominal cut-off frequency of 25 Hz.

$$S(m,k)=\sum_{l=-10}^{10} h_{LPF1}(l+10)P(M+m-l,k) \qquad 9.2.7$$

$$0\leqq k\leqq K(M+m),\ 0<m\leqq M.$$

The REW is computed by a complimentary high-pass filtering operation or more directly by subtracting the SEW from the PW.

$$R(m,k)=P(m,k)-S(m,k)\ 0\leqq k\leqq K(M+m),\ 0<m\leqq M. \qquad 9.2.8$$

The PW gain sequence is also sampled at 500 Hz. However, the bandwidth of PW gain can be reduced without affecting performance. This is done by filtering $\{G_{pw}(M+m)\}$ through a 21-tap linear phase low pass FIR filter with a nominal cut-off frequency of 125 Hz.

$$G_{pw}^{f}(m)=\sum_{l=-10}^{10} h_{LPF2}(l+10)G_{pw}(m-l)\ \ 0<m\leq M. \qquad 9.2.9$$

This allows PW gain to be decimated by rate ½ by dropping all the odd indexed values, resulting M/2 PW gain values per frame, 9.3 PW Gain Quantization The filtered and decimated PW gain sequence $\{G_{pw}^{f}(m), m=2,4,6,8,10\}$ is converted to logarithmic domain by the following transformation:

$$\overline{G}_{pw}^{f}(m)=92-20\log_{10}G_{pw}^{f}(m),\ m=2,4,6,8,10. \qquad 9.3.1$$

The transformed gain is limited to the range 0–92 by clamping to the maximum or minimum value if it is above or below the range respectively. Conversion to logarithmic domain is advantageous since it corresponds to the scale of loudness of sound perceived by the human ear. A larger dynamic range can be represented in the logarithmic domain.

The transformed PW gain vector is vector quantized using an 8-bit, 5-dimensional vector quantizer. The design of the vector quantizer is a novel aspect of this invention. The PW gain sequence can exhibit two distinct modes of behavior. When the signal is stationary, the gain sequence has a small degree of variations across a frame. During non-stationary signals such as voicing onsets, the gain sequence exhibits sharp variations. It is necessary that the vector quantizer is able to capture both types of behavior. On the average, stationary frames far outnumber the non-stationary frames. If a vector quantizer is trained using a database, which does not distinguish between the two types, the training is dominated by stationary frames leading to poor performance for non-stationary frames. To overcome this problem, the vector quantizer design was modified. The PW gain vectors were classified into a stationary class and a non-stationary class. For the 256 level codebook, 192 levels were allocated to represent stationary frames and the remaining 64 were allocated for non-stationary frames. The 192 level codebook is trained using the stationary frames, and the 64 level codebook is trained using the non-stationary frames. The training algorithm is based on the generalized Lloyd algorithm Digital Coding of Waveforms, N. S. Jayant and Peter Noll, Prentice-Hall 1984, with a binary split and random perturbation. In the case of the stationary codebook, the 192 level codebook is derived by performing a ternary split of the 64 level codebook during the training process.

This 192 level codebook and the 64 level codebook are concatenated to obtain the 256-level gain codebook. During quantization, no stationary/nonstationary classification is performed. Instead, the entire 256-level codebook is searched to locate the optimal quantized gain vector. The quantizer uses a mean squared error distortion metric:

$$D_g(l)=\sum_{m=1}^{5}\left[\overline{G}_{pw}^{f}(2m)-V_g^{l}(m)\right]^2 \quad 0\leq l<256, \qquad 9.3.2$$

where $\{V_g^{l}(m), 0<m\leqq 5\}$ is the $l^{th}$ codeword in the codebook. If this distortion is minimized for the index $l^*$, the even-indexed elements of the decoded PW gain vector are reconstructed by $$\tilde{G}_{pw}(2m+2)=10^{\frac{92-V_g^{l^*}(m)}{20}} \quad 0<m\leq\frac{M}{2}. \qquad 9.3.3$$

The odd-indexed elements of the PW gain vector are reconstructed by linearly interpolating between the decoded even-indexed elements:

$$\tilde{G}_{pw}(2m+1)=\frac{\tilde{G}_{pw}(2m)+\tilde{G}_{pw}(2m+2)}{2} \quad 0\leq m<\frac{M}{2}. \qquad 9.3.4$$

9.4 SEW Quantization

The bandwidth of SEW is limited to 25 Hz by the low-pass filtering operation in (9.2.7). This implies that the sampling rate for SEW can be reduced from 500 Hz to 50 Hz, i.e., once each 20 ms frame. Consequently, SEW is decimated by 10:1 and only the SEW vector at the frame edge, i.e., $\{S(M,k)\}$ is encoded. At the decoder, SEW vectors at frame edges are interpolated to obtain the intermediate SEW vectors. In quantizing the SEW, the following should be noted:

1) SEW is a perceptually important component and has a strong influence on the perceived quality of the reproduced speech during periodic and quasi-periodic frames. It is important to preserve the static as well as the dynamic characteristics of this component. Hence, at low coding rates such as 2–4 kbit/s, a significant fraction of the bits used for coding the residual signal is used for coding the SEW.

2) The dimension of the SEW component is not fixed, but varies with the pitch frequency. The dimension can be rather high when the pitch frequency is small. If the pitch period varies in the range 20–120 samples, the dimension varies in the range 11–61.

These two factors together make conventional vector quantization of SEW impractical from a computational as well as a storage perspective. In prior art, some techniques have been proposed to overcome these problems. It is proposed that the magnitude of the SEW vector is estimated as unity minus the REW vector magnitude, where the latter is encoded using analytical function approximations. The phase of the SEW vector is coded as a random phase or a fixed pitch pulse phase based on an unvoiced/voiced decision; only the 0–800 Hz band of the SEW magnitude is encoded. The remaining 800–4000 Hz band is constructed as unity minus REW magnitude. Both these approaches compromise the accuracy of SEW magnitude vector. In this invention, a novel approach is proposed for encoding the SEW.

The complex SEW vector is quantized in the magnitude-phase form. In this form, the SEW magnitude information which is perceptually more significant, can be quantized more precisely with a higher number of bits than the phase. The phase information which is relatively less significant can be quantized with fewer bits.

To overcome the problems of variable dimension and complexity, the SEW magnitude vector is quantized using a hierarchical mean-gain-shape approach with switched prediction. This approach allows the use of fixed dimension VQ with a moderate number of levels and precise quantization of perceptually important components of the magnitude spectrum.

In this approach, the SEW magnitude spectrum is viewed as the sum of two components: (1) a SEW mean component, which is obtained by averaging of the SEW magnitude across frequency, within a 5 band sub-band structure, and (2) a SEW deviation component, which is the difference between the SEW magnitude and the SEW mean. The SEW mean component captures the average level of the SEW magnitude across frequency, which is important to preserve during encoding. The SEW deviation contains the finer structure of the SEW magnitude spectrum and is not important at all frequencies. It is only necessary to preserve the SEW deviation at a small set of frequencies as will be discussed later. The remaining elements of SEW deviation can be discarded, leading to a considerable reduction in the dimensionality of the SEW deviation.

9.4.1 Computation of SEW Mean and SEW Deviation

The five sub-bands for computing the SEW mean are 1–400 Hz, 400–800 Hz, 800–1600 Hz, 1600–2400 Hz and 2400–3400 Hz. Based on this band structure, the corresponding discrete frequency band edges can be computed as follows:

$$k_{low}(0) = \frac{\pi}{8000\ w_p(N)}, \quad k_{high}(0) = \frac{400\pi}{8000\ w_p(N)}, \qquad 9.4.1$$

$$k_{low}(1) = \frac{400\pi}{8000\ w_p(N)}, \quad k_{high}(1) = \frac{800\pi}{8000\ w_p(N)},$$

$$k_{low}(2) = \frac{800\pi}{8000\ w_p(N)}, \quad k_{high}(2) = \frac{1600\pi}{8000\ w_p(N)},$$

$$k_{low}(3) = \frac{1600\pi}{8000\ w_p(N)}, \quad k_{high}(3) = \frac{2400\pi}{8000\ w_p(N)},$$

$$k_{low}(4) = \frac{2400\pi}{8000\ w_p(N)}, \quad k_{high}(4) = \frac{3400\pi}{8000\ w_p(N)}.$$

The SEW mean is computed from the SEW magnitude vector as follows:

$$\bar{S}(M, i) = \frac{1}{N_{band}(i)} \sum_{k_{low}(i) \le k < k_{high}(i)} |S(M, k)| \quad 0 \le i < 5. \qquad 9.4.2$$

where, $N_{band}(i)$ is the number of harmonics falling in the $i^{th}$ sub-band. A piecewise-constant approximation to the SEW magnitude vector can be constructed based on the SEW mean vector as follows:

$$\check{S}(M,k)=\bar{S}(M,i)\ 0 \le k \le K(M) \text{ and where } 0 \le i < 5 \text{ is such that } k \text{ satisfies } k_{low}(i) \le k < k_{high}(i) \qquad 9.4.3$$

The SEW deviation vector is computed by subtracting the SEW mean approximation from the SEW magnitude vector:

$$\tilde{S}(M,k)=|S(M,k)|-\check{S}(M,k)\ 0 \le k \le K(M). \qquad 9.4.4$$

9.4.2 Selection of SEW Magnitude Deviation Elements

The SEW magnitude deviation vector has a dimension of K(M), which varies in the range 11–61 depending on the pitch frequency. In order to quantize this vector, it is desirable to convert it into a fixed dimension vector with a small dimension. This is possible if the elements of this vector can be prioritized in some sense, i.e., if more important elements can be distinguished from less important elements. In such a case, a certain number of important elements can be retained and the rest can be discarded. A criterion that can be used to prioritize these elements can be derived by noting that in general, the spectral components that lie in the vicinity of speech formant peaks are more important than those that lie in regions of lower power spectral amplitude. However, the input speech power spectrum cannot be used directly, since this information is not available to the decoder. Note that the decoder should also be able to map the selected elements to their correct locations in the full dimension vector. To permit this, the power spectrum provided by the quantized LPC parameters, which is an approximation to the speech power spectrum (to within a scale constant) is used. Since the quantized LPC parameters are identical at the encoder and the decoder (in the absence of channel errors), the locations of the selected elements can be deduced correctly at the decoder.

The spectral magnitude estimate provided by the quantized LPC parameters can be computed as $$H_{lpc}(M, k) = \frac{1}{\sqrt{\left|\sum_{l=0}^{L} \alpha_l(M) e^{-jw_p(N)kl}\right|^2}} \quad 0 \le k \le K(M). \qquad 9.4.5$$

However, it is desirable to modify this estimate for the purposes of coefficient selection and spectral weighting as follows:

$$H_{wlpc}(M, k) = \sqrt{\frac{\left|\sum_{l=0}^{L} \alpha_l(M)\beta^l e^{-jw_p(N)kl}\right|^2}{\left|\sum_{l=0}^{L} \alpha_l(M)\alpha^l e^{-jw_p(N)kl}\right|^2}} \quad 0 \le k \le K(M). \qquad 9.4.6$$

Here, $\alpha$ and $\beta$ are formant bandwidth expansion factors, which reduce excessive peakiness at the formant frequencies. These must satisfy the constraint:

$$0 \le \beta < \alpha \le 1.$$

A typical choice for these parameters is $\alpha=0.9$ and $\beta=0.75$. The modified spectral estimate has been found to result in better performance.

The elements $\{H_{wlpc}(M,k), 0 \le k \le K(M)\}$ are sorted in an ascending order. Let $\{\mu''(k), 0 \le k \le K(M)\}$ define the sorted order such that $$H_{wlpc}(M,\mu''(k_2)) \ge H_{wlpc}(M,\mu''(k_1)) \text{ if } 0 \le k_1 \le k_2 \le K(M). \qquad 9,4.7$$

Then, the set of $N_{sel}$ highest valued elements of $H_{wlpc}$ can be indexed as shown below:

$$\{H_{wlpc}(M,\mu''(k)),\ K(M)-N_{sel} < k \le K(M)\}. \qquad 9.4.8$$

When the pitch frequency is large, it is possible that some of the SEW mean sub-bands contain a single SEW magnitude harmonic. In this case, this harmonic is entirely represented by the SEW mean and the SEW deviation is guaranteed to be zero valued. It is wasteful to select such components of SEW deviation for encoding. To eliminate this possibility, the sorted order vector $\mu''$ is modified by examining the highest $N_{sel}$ elements. If any of these elements correspond to single harmonics in the sub-band, which they occupy, these elements are unselected and replaced by an unselected element with the next highest $H_{wlpc}$ value, which is not a single harmonic in its band. Let $\{\mu u'(k), 0 \leqq k \leqq K(M)\}$ denote the modified sorted order. The highest $N_{sel}$ indices of $\mu'$ indicate the selected elements of SEW deviations for encoding.

A second reordering is performed to improve the performance of predictive encoding of SEW deviation vector. For predictive quantization, it is advantageous to order the highest $N_{sel}$ indices of $\mu'$ based on index values. In our implementation, descending order has been used, but ascending order can also be used. Let $\{\mu(k), 0 \leqq k \leqq K(M)\}$ denote the ordering after this modification. Then $\mu(k)$ satisfies $$\{\mu(k_1)>\mu(k_2)),\ K(M)-N_{sel}<k_1<k_2 \leqq K(M))\}. \qquad 9.4.9$$

This reordering ensures that lower (higher) frequency components are predicted using lower (higher) frequency components as long as the pitch frequency variations are not large. Note that since this reordering is within the subset of selected indices, it does not alter the contents of the set of selected elements, but merely the order in which they are arranged. This set of elements in the SEW deviation vector is selected as the $N_{sel}$ most important elements for encoding. These are indexed as shown below:

$$\{\tilde{S}(M,\mu(k)),\ K(M)-N_{sel}<k \leqq K(M)\} \qquad 9.4.10$$

Using the selected elements, a $N_{sel}$-dimension SEW deviation sub-vector is formed:

$$\tilde{S}_{sel}(M,K(M)-k)=\tilde{S}(M,\mu(k)),\ K(M)-N_{sel}<k \leqq K(M). \qquad 9.4.11$$

The remaining elements of the SEW deviation vector, i.e., $$\{\tilde{S}(M,\mu(k)), 0 \leqq k \leqq K(M)-N_{sel}\} \qquad 9.4.12$$

are not encoded. A typical value of $N_{sel}$, which has been used in our realization, is $N_{sel}=10$.

9.4.3 SEW Deviations Vector Prediction

The SEW deviations sub-vector is encoded by a predictive vector quantizer. A first order switched predictor is employed, with the prediction coefficient either $\alpha_p=0$ (non-predictive mode) or $\alpha_p=0.6$ (predictive mode). The prediction mode is common to the SEW mean vector quantization, i.e., both SEW mean and SEW deviation are encoded non-predictively or they are both encoded predictively. The mode selected by carrying out the SEW deviation and SEW mean quantizations in predictive as well as in non-predictive modes, and by choosing the mode that yields the smaller distortion between the unquantized and quantized SEW magnitude vectors. The mode is encoded using a 1-bit index.

Figure 2:
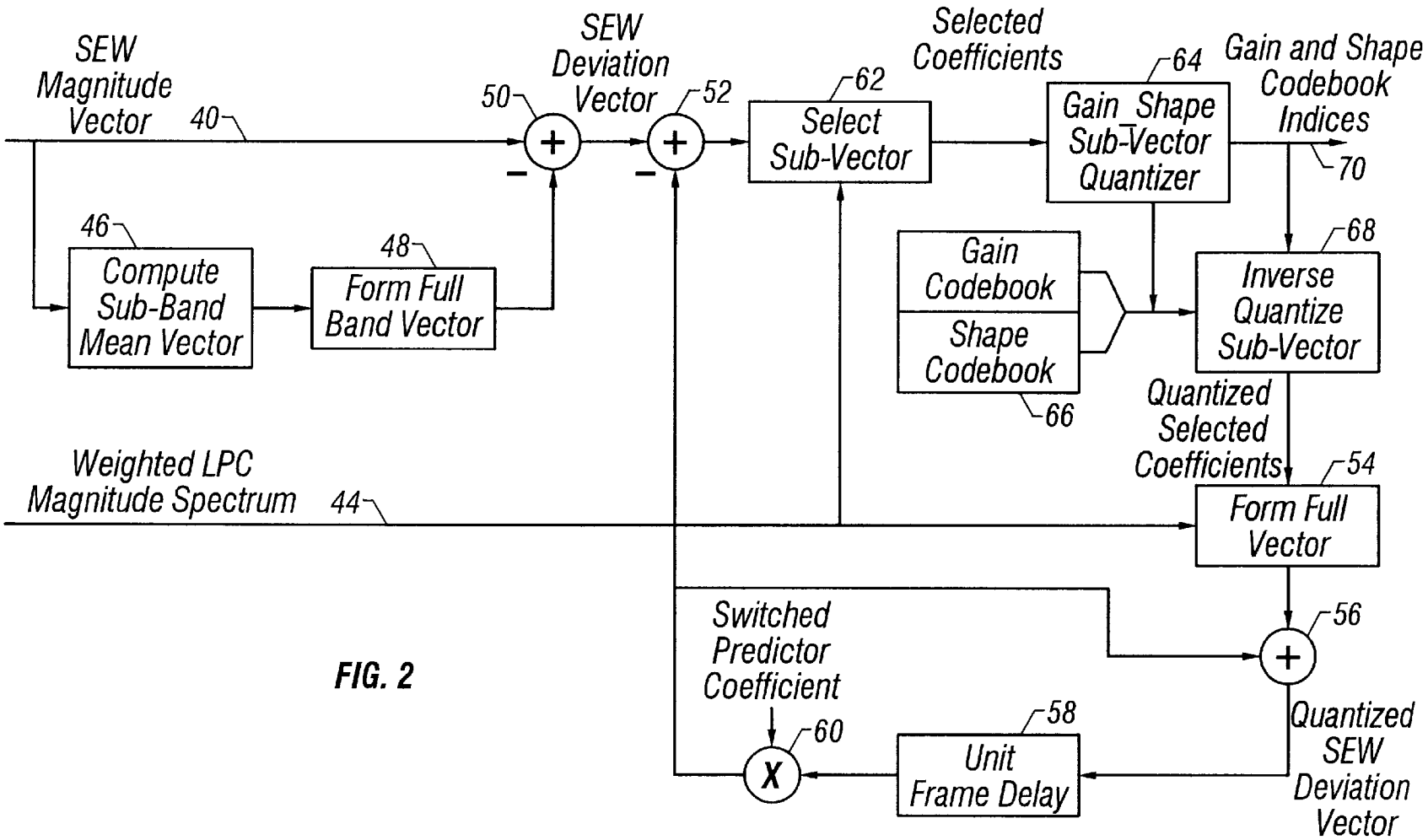
FIG. 2 is a block diagram illustrating the predictive vector quantization of the SEW deviations sub-vector.

The operation of the predictor is illustrated in FIG. 2. FIG. 2 shows a block diagram illustrating the predictive vector quantization of the SEW deviation sub-vector. The SEW magnitude vector 40 and a weighted LPC magnitude spectrum 44 provide input signals for quantization of the SEW vector such that block 46 computes the sub-band mean vector and a full band vector is formed at block 48 to provide an arithmetic difference signal at 50 which outputs the SEW deviation vector from which a predicted SEW deviation vector is subtracted to select the sub-vector 62 from which selected coefficients are provided to a $gain_{13}$ shape sub-vector quantizer 64. The sub-vector quantizer 64 utilizes gain and shape codebooks 66 to provide gain and shape codebook indices 70. The quantized SEW deviation vector is provided from an inverse quantized sub-vector 68 which uses the weighted LPC spectrum 44 and quantized selected coefficients to form the full vector 54 which is summed at adder 56 and unit frame delayed at block 58 providing a signal for mixing with the switched predictor coefficient at mixer 60.

Let $\{\tilde{S}_q(0,k), 0 \leqq k \leqq K(0)\}$ be the quantized SEW deviation vector of the previous frame, which becomes the state vector of the predictor for the current frame. Since the dimension of the SEW vector changes from frame to frame due to changing pitch frequency, it is necessary to equalize the dimension of the predictor state vector with the dimension of the current SEW deviation vector, before prediction can be performed. If the number of harmonics in the previous frame is less than that in the current frame, i.e., $K(0)<K(M)$, $\{\tilde{S}_q(0,k)\}$ is padded with zeros until its dimension is $K(M)+1$. If the number of harmonics in the previous frame is greater than that in the current frame, i.e., $K(0)>K(M)$, the elements $\{\tilde{S}_q(0,k), K(M)<k \leqq K(0)\}$ are set to zero.

Since only the selected elements of SEW deviations are being encoded, it is necessary to perform prediction (i.e., compute the prediction error) only for the selected elements as follows:

$$E_{sew}(i)=\tilde{S}_{sel}(M,i)-\alpha_p\tilde{S}_q(0,\mu(K(M)-i)),\ 0 \leqq i<N_{sel}. \qquad 9.4.13$$

Note that the dimension of the prediction error vector $E_{sew}$ is $N_{sel}$, which is a fixed dimension. This vector is quantized using a gain-shape quantization.

9.4.4 Gain-Shape Quantization of the SEW Deviation Prediction Error

The SEW magnitude deviation prediction error vector $\{E_{sew}(i), 0 \leqq i<N_{sel}\}$ is quantized using a gain-shape vector quantizer. A 3-bit gain codebook and an 8-bit shape codebook are used. Both these codebooks are trained using a large data base of SEW deviation prediction error vectors. The gain and shape codebooks are jointly searched, i.e., for each of the 8 gain entries, all the 256 shape vectors are evaluated, and the gain-shape combination that provides the smallest distortion is used as the optimal encoding. A spectrally weighted distortion measure is used. The spectral weighting is identical to the LPC spectral estimate given by $H_{wlpc}$ from (9.4.6). The distortion metric for the $m^{th}$ gain codebook entry $g_{sew}{}^m$ and the $n^{th}$ shape codebook entry $V_{sewsh}{}^n$ is expressed as $$D_{sew}(m,n)=\sum_{i=0}^{N_{sel}-1}[g_{sew}^m V_{sewsh}^n(i)-E_{sew}(i)]^2 H_{wlpc}(M,\mu(K(M)-i)) \qquad 9.4.14$$

$$0 \leqq m<8,\ 0 \leqq n<256.$$

Let m* and n* respectively be the gain index and shape codebook index that together minimize the above distortion measure. Then, the encoded SEW deviations prediction error vector is given in terms of the optimal gain and shape vector by $$\hat{E}_{sew}(i)=g_{sew}{}^{m^*}V_{sewsh}{}^{n^*}(i),\ 0 \leqq i<N_{sel}. \qquad 9.4.15$$

The encoded SEW deviation vector is computed by adding the predicted component and the encoded prediction error vectors:

$$\tilde{S}_q(M,\mu(k))=\hat{E}_{sew}(K(M)-k)+\alpha_p\tilde{S}_q(0,\mu(k)),\ K(M)-N_{sel}<k \leqq K(M),$$

$$\tilde{S}_q(M,\mu(k))=\alpha_p\tilde{S}_q(0,\mu(k))\ 0 \leqq k \leqq K(M)-_{sel}. \qquad 9.4.16$$

Note that the encoded prediction error makes a contribution only for the selected elements. For the unselected elements, there is no prediction error contribution, which is equivalent to assuming that the encoded prediction error is zero. The unselected elements are determined only by an attenuated version of the predictor state vector, since $\alpha_p$ is strictly less than unity.

9.4.5 SEW Mean Vector Prediction

The SEW mean quantization is performed after the SEW deviation vector is quantized and $\{\tilde{S}_q(M, k)\}$ has been determined. Note that the sum of the quantized SEW mean vector and the quantized SEW deviation vector is the quantized SEW magnitude vector. Thus, SEW mean quantization in effect determines an additive correction to the quantized SEW deviation that achieves minimal distortion with respect to the SEW magnitude. The SEW mean vector as given by (9.4.2), is a 5-dimensional vector. It is encoded by a 6-bit predictive vector quantizer. The predictor is a switched predictor with the prediction coefficient either $\beta_p=0$ (non-predictive mode) or $\beta_p=0.9$ (predictive mode).

In addition to the predictor mode, the SEW mean vector quantization is also switched depending on a parameter known as voicing measure, which will be discussed in Section 9.5. The voicing measure represents the degree of periodicity and is transmitted to the decoder using 3 bits where it is used to derive the SEW and REW phases. Since the SEW level increases with the degree of periodicity, the voicing measure can be exploited in SEW magnitude quantization also. This is done by training two sets of SEW mean codebooks, one set corresponding to a high degree of periodicity (voicing measure≦0.3) and the second corresponding to a low degree of periodicity (voicing measure>0.3). Both the encoder and the decoder select the codebooks depending on the quantized voicing measure. In the following discussion, it is assumed that the codebook $\{C_{sm}^{l}(k), 0 \leqq k \leqq K(M)\}$ has been selected based on the quantized voicing measure.

Figure 3:
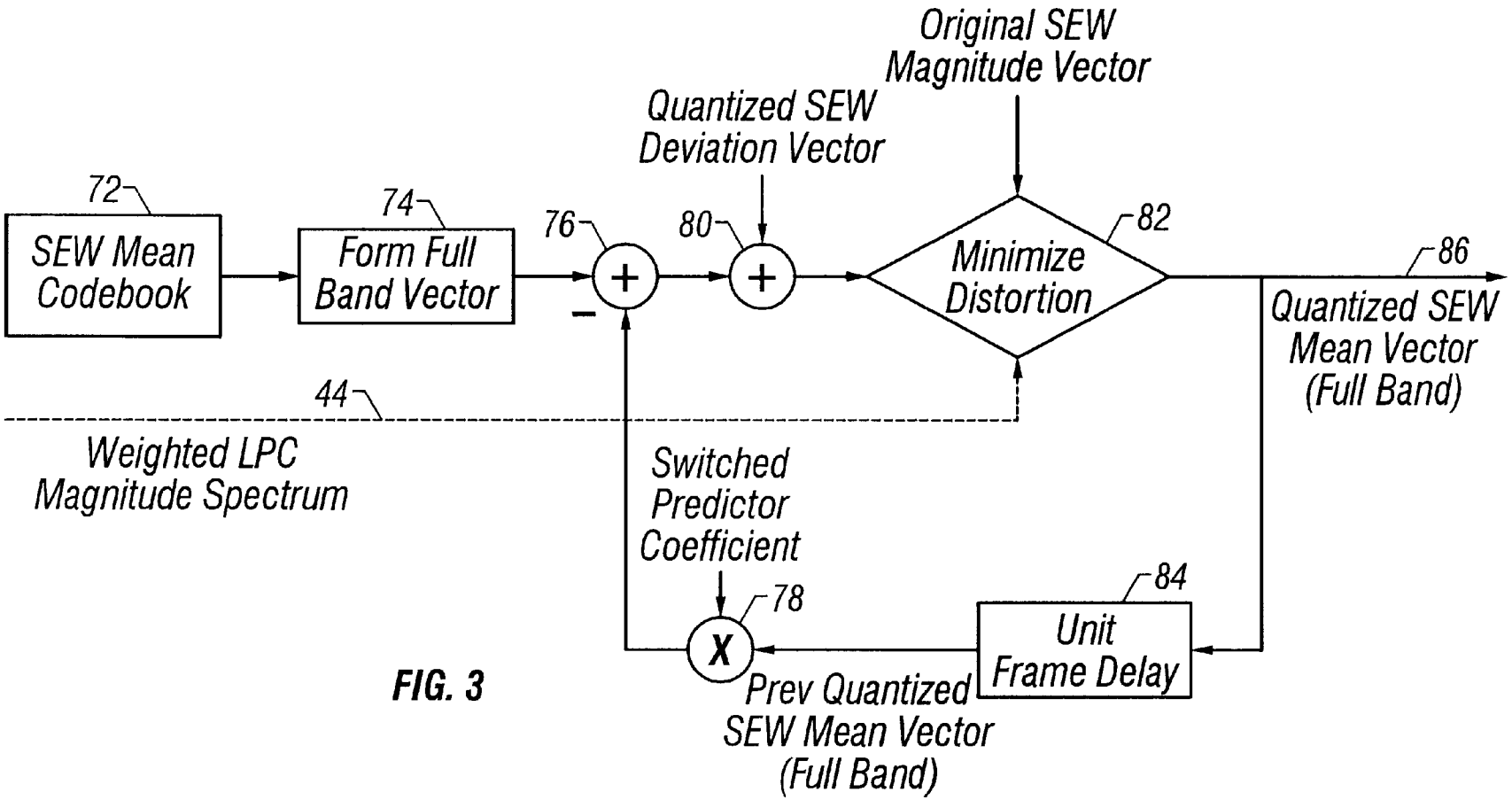
FIG. 3 is a block diagram illustrating the predictive vector quantization of SEW sub-band mean vector.

A block diagram illustrating the SEW mean vector predictive quantization scheme is presented in FIG. 3. The predictive vector quantization of the SEW sub-band mean vector uses the SEW mean codebook 72 to form the full band vector 74 for a difference signal from adder 76 which is added with a quantized SEW deviation vector at adder 80. The original SEW magnitude vector is used with the weighted LPC magnitude spectrum 44 to minimize distortion 82 in the output quantized SEW mean vector (full band) 86. The full band quantized SEW mean vector is unit frame delayed at block 84 and mixed with a switched predictor coefficient at mixer 78 to provide a difference signal for the predictive quantization scheme.

Let $\{\bar{S}_q(0,i), 0 \leqq i<5\}$ be the encoded SEW mean vector for the previous frame. Then, a full-dimension piecewise-constant SEW mean vector can be constructed as follows:

$$\check{S}_q(0,k)=\tilde{S}_q((0,i) \text{ where } 0 \leqq i<5 \text{ is such that } k \text{ satisfies } k_{low}(i) \leqq k<k_{high}(i). \quad 9.4.17$$

The encoded SEW mean vector for the previous frame is also the state vector for the predictor during the current frame. A target vector can be defined for predictive quantization of SEW mean as:

$$T_{sm}(k)=|S(M,k)|-\tilde{S}_q(M,k),\ 0 \leqq k \leqq K(M). \quad 9.4.18a$$

Let $\{_{sm}^{l}(i), 0 \leqq i<5\}$ represent the SEW mean codebook selected based on the prediction mode and the voicing measure. For each codevector in this codebook, a full dimension vector is constructed by $$C_{sm}^{l}(k)=V_{sm}^{l}(i) 0 \leqq k \leqq K(M) \text{and where } 0 \leqq i<5 \text{ is such that } k \text{ satisfies } k_{low}(i) \leqq k<k_{high}(i) \quad 9.4.18b$$

Then, for each codevector, a SEW mean estimate is computed as $$\bar{S}_{est}^{l}(k)=\mathrm{MAX}(0.1, C_{sm}^{l}(k)+\beta_p\check{S}_q(0,k),\ 0 \leqq k \leqq K(M). \quad 9.4.19a$$

where MAX(a,b) represents the larger of the two arguments a and b. Here we exploit the apriori knowledge that the SEW mean vector is strictly positive and in fact seldom falls be low the value of 0.1.

Then, a target vector can be defined for predictive quantization of SEW mean as:

$$T_{sm}(k)=|S(M,k)|-\tilde{S}_q(M,k)-\beta_p\check{S}_q(0,k),\ 0 \leqq k \leqq K(M). \quad 9.4.19b$$

The vector quantizer selects the codevector that minimizes the distortion between the target vector and the SEW mean estimate vector. This is equivalent to minimizing the error that still remains after the quantized SEW deviation component and the SEW mean prediction component have be en taken into account. It is precisely this error that must be minimized by the quantization of the SEW mean prediction error. The distortion measure is defined by:

$$D_{sm}(l)=\sum_{k=0}^{K(M)}\left[T_{sm}(k)-\bar{S}_{est}^{l}(k)\right]^2 H_{wlpc}(M,k) \quad 0 \leq l<64. \quad 9.4.20$$

The optimal codevector index l* is determined by minimizing the above distortion over all the SEW mean prediction error codevectors in the codebook. The encoded SEW mean vector is reconstructed by add ing the optimal codevector to the SEW mean prediction component:

$$\bar{S}_q(M,i)=\mathrm{MAX}(0.1, V_{sm}^{l*}(i)+\beta_p\bar{S}_q(0,i)),\ 0 \leqq i<5. \quad 9.4.21$$

9.4.6 Selection of SEW Prediction Mode

As mentioned earlier, the predictor mode for SEW deviation and SEW mean encoding is jointly determined based on the overall distortion achieved. The SEW deviation encoding and SEW mean encoding are carried out first in non-predictive mode, i.e., with $\alpha_p=0$ and $\beta_p=0$. Note that this implies equations (9.4.13)–(9.4.16) are evaluated with $\alpha_p=0$ and equations (9.4.17)–(9.4.19) are evaluated with $\beta_p=0$, leading to an overall distortion given by (9.4.20). Next, the SEW deviation encoding and SEW mean encoding are carried out in predictive mode, i.e., with $\alpha_p=0.6$ and $\beta_p=0.9$. This implies that the equations (9.4.13)–(9.4.16) are evaluated with $\alpha_p=0.6$ and equations (9.4.17)–(9.4.19) are evaluated with $\beta_p=0.9$, leading to an overall distortion given by (9.4.20). If the overall distortions in non-predictive and predictive cases respectively are $D_{sm}^{np}$ and $D_{sm}^{p}$, the prediction mode is determined by $$D_{sm}^{np} \leqq D_{sm}^{p}\text{: non-predictive } D_{sm}^{np}>D_{sm}^{p}\text{: predictive} \quad 9.4.22$$

The prediction mode is encoded using a single bit. The optimal SEW mean, SEW deviation gain and shape indices $\{l^*, m^*, n^*\}$ are selected as those obtained under the optimal predictor mode. The SEW mean index is coded using 6 bits, SEW deviation gain index using 3 bits and SEW deviation shape is coded using 8 bits.

9.4.7 Reconstruction of the Quantized SEW Magnitude Vector

The SEW magnitude vector is reconstructed by adding the quantized SEW mean and the SEW deviation components. Depending upon the prediction mode selected, $\alpha_p=0$ and $\beta_p=0$ or $\alpha_p=0.6$ and $\beta_p=0.9$ are used. Let l*,m*,n* denote the optimal SEW mean, SEW deviation gain and shape indices in that order. The SEW deviation vector is reconstructed using (9.4.16). The SEW mean is reconstructed using (9.4.21). A full-dimension piecewise-constant SEW mean vector is constructed by:

$$\tilde{S}_q(M,k)=\bar{S}_q(M,i)\ 0\leqq k\leqq K(M) \text{ and where } 0\leqq i<5 \text{ is such that } k \text{ satisfies } k_{low}(i)\leqq k<k_{high}(i) \qquad 9.4.23$$

Then the SEW magnitude vector can be reconstructed as $$|S_q(M,k)|=\tilde{S}_q(M,k)+\tilde{S}_q(M,k)\ 0\leqq k\leqq K(M). \qquad 9.4.24$$

It is possible that due to quantization errors in either the SEW mean or the SEW deviation, the resulting SEW magnitude for some elements assumes negative values, which is invalid. This is corrected by setting such values to a small fraction of the SEW mean value, which is guaranteed to be positive:

$$|S_q(M,k)|=0.1\tilde{S}(M,k) \text{ if } \tilde{S}_q(M,k)+\tilde{S}_q(M,k)<0\ 0\leqq k\leqq K(M). \qquad 9.4.25$$

This completes the reconstruction of the quantized SEW magnitude vector.

9.5 SEW Phase Representation by Voicing Measure

The SEW phase is not quantized directly, but is represented using a voicing measure, which is quantized and transmitted to the decoder. The voicing measure is estimated for each frame based on certain characteristics of the frame, It is a heuristic measure that assigns a degree of periodicity to each frame. The voicing measure for the current frame, denoted by v(M), occupies the range of values $0\leqq v(M)\leqq 1$, with 0 indicating a perfectly voiced or periodic frame and 1 indicating a completely unvoiced or aperiodic frame. It serves to indicate the extent to which the SEW phase should be harmonic or randomized, to achieve the right balance between smoothness and roughness of sound.

The voicing measure is determined based on three measured characteristics of the current frame. These are, the weighted RMS value of the SEW, the average variance of the SEW harmonics across the frame and the pitch gain. The weighted RMS value of the SEW is computed by:

$$rms_{sew}=\sqrt{\frac{\sum_{k\in k_{1250}}|S(M,k)|^2H_{wlpc}(M,k)}{\sum_{k\in k_{1250}}H_{wlpc}(M,k)}}, \qquad 9.5.1$$

where, $$k_{1250}=\left\{k,\ 1\leq k\leq K(M) \text{ and } 1<\frac{k\pi 4000}{w_p(N)}\leq 1250\right\}.$$

The SEW RMS measure is directly proportional to the degree of periodicity of the residual signal. It is also robust to the presence of background noise. Since it is normalized by the weighting function, its values are restricted to the range 0–1.

The average variance of the SEW harmonics across the frame is computed as follows. First, the average value of the SEW across the current frame is measured at each harmonic as a complex vector:

$$dc_{sew}(k)=\frac{1}{M}\sum_{m=1}^{M}S(m,k)\quad 0\leq k\leq K(M). \qquad 9.5.2$$

Next the variance of the SEW across the current frame is measured at each harmonic:

$$var_{sew}(k)=\frac{\sum_{m=1}^{M}|S(m,k)-dc_{sew}(k)|^2}{\sum_{m=1}^{M}|S(m,k)|^2}\quad 0\leq k\leq K(M). \qquad 9.5.3$$

Note that this is a normalized variance whose values are restricted to the range 0–1. Finally a weighted average of the variance is obtained by averaging across the harmonics:

$$avgvar_{sew}=\frac{\sum_{k=0}^{K(M)}var_{sew}(k)H_{wlpc}^2(M,k)}{\sum_{k=0}^{K(M)}H_{wlpc}^2(M,k)}. \qquad 9.5.4$$

The SEW variance provides a measure of the degree of variation if SEW. As the periodicity in the frame increases, the variations in the SEW diminish leading to a decrease in the SEW variance as measured above. Consequently, this measure is a good indicator of the degree of periodicity of the signal.

The pitch gain is a parameter that is computed as part of the pitch analysis function. It is essentially the value of the peak of the autocorrelation function of the residual signal at the pitch lag. However, to avoid spurious peaks, it is advantageous to compute a composite autocorrelation function, as an average of adjacent residual autocorrelation functions. The details of the computation of the autocorrelation function will not be discussed here, as it is not directly related to the coding of the residual. It will be assumed that $\{r_{comp}(l),\ 0\leqq l\leqq 120\}$ is a composite autocorrelation function that has been computed by a suitable method. The pitch gain parameter is obtained by finding the lag $l_{max}$ at which the highest positive peak of the autocorrelation function is located. Then, pitch gain is given by $$\beta_{pitch}=\frac{r_{comp}(l_{\max})}{r_{comp}(0)}. \qquad 9.5.5$$

These three parameters provide a measure of the degree of variation of SEW. As the periodicity in the frame increases, the RMS value of the SEW increases, the variations in the SEW diminish leading to a decrease in the SEW variance, and the pitch gain increases. As the periodicity in the frame decreases, the RMS value of the SEW decreases, the variations in the SEW increase leading to an increase in the SEW variance, and the pitch gain decreases. Any single one of these parameters may give an occasional erroneous indication. However, if all three parameters are considered simultaneously, it is possible to derive a robust and dependable voicing measure, even when the input signal is degraded by background noise. In order to perform this mapping of the 3-dimensional parameter space into a scalar voicing measure, a neural network is employed. The three parameters are linearly transformed to make the parameter range and orientation better suited for processing by the neural network. Let $\{n_{ip}(i),0\leqq i<3\}$ designate a vector that contains the transformed parameters, and serves as the input vector for the neural network. Then the transformations are as follows:

$$n_{ip}(0) = 1 - \frac{rms_{sew} - 0.2}{1.3}, \quad n_{ip}(1) = \frac{avgvar_{sew}}{0.5}, \quad n_{ip}(2) = 1 - \frac{\beta_{pitch}}{0.9}. \tag{9.5.6}$$

Figure 4:
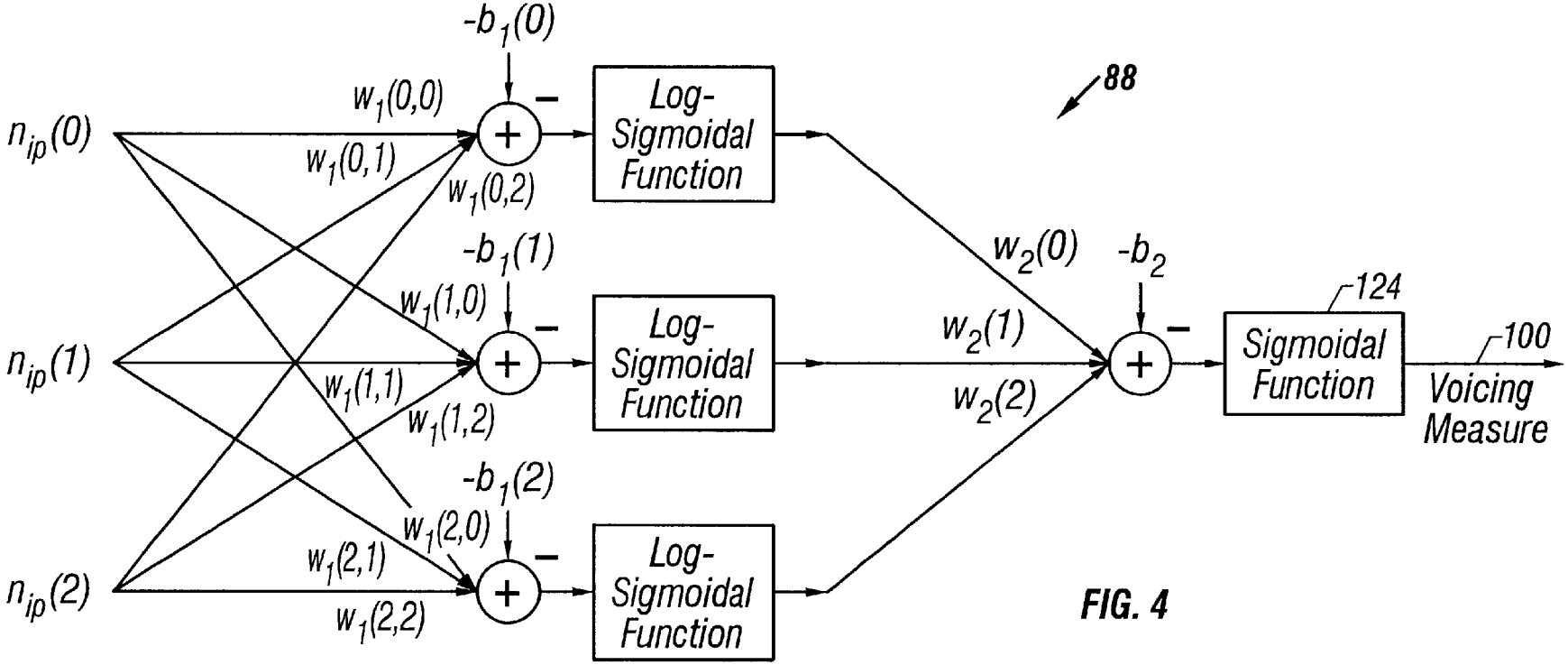
FIG. 4 is a neural network structure for the computation of the voicing measure.

The neural network structure is illustrated in FIG. 4. The neural network structure 88 is provided for the computation of the voicing measure. The neural network 88 employs a butterfly structure with log-sigmoidal functions which are arithmetically combined as input to a sigmoidal function block 124 for generation of the voicing measure output signal 100. The output of the first layer (i.e., the input layer) is computated as follows:

$$n_{op1}(i) = \frac{1}{\left(1 + e^{-b_1(i) - \sum_{j=0}^{2} w_1(i,j) n_{ip}(j)}\right)} \qquad 0 \le i < 3. \tag{9.5.7}$$

The result of the output layer computation is the voicing measure. This is given by $$v(M) = \frac{1}{\left(1 + e^{-b_2 - \sum_{j=0}^{2} w_2(j) n_{op1}(j)}\right)}. \tag{9.5.8}$$

In the above equations, the parameters $w_1$, $w_2$, $b_1$ and $b_2$ are the neural network parameters. These are given by $$w_1 = \begin{bmatrix} 11.0483 & 0.1235 & -0.0854 \\ 19.3868 & 1.0798 & 13.4444 \\ 4.3699 & 11.7996 & 17.3152 \end{bmatrix}, \quad w_2 = [5.8367 \;\; 5.8867 \;\; 7.3618], \quad b_1 = \begin{bmatrix} -6.1725 \\ -6.5954 \\ -2.4044 \end{bmatrix}, \quad b_2 = 15.9540. \tag{9.5.9}$$

The voicing measure is encoded using a 3-bit scalar quantizer.

The accuracy of the voicing measure can be improved by using additional parameters which are correlated to the degree of periodicity of the signal. For example, parameters such as relative signal power, a measure of peakiness of the prediction residual, REW rms level and the normalized autocorrelation of the input signal at unit lag have been found to improve the accuracy of the voicing measure. These parameters can be used as inputs to a second neural network and the outputs of the two neural networks can be combined (e.g., by averaging). Alternately, these parameters can be used in conjunction with the original set of parameters as inputs to a single neural network with a higher number of inputs. In either case, the basic approach outlined above can be directly extended to including other parameter sets as well as other types of classifiers.

REW Magnitude Quantization

The REW contains the aperiodic components in the residual signal. Since REW has a high evolutionary bandwidth, it is necessary to encode the REW many times within a frame. However, since the REW is perceptually less important than SEW, the coding of the REW can be much coarser than that of SEW.

The sampling rate of the REW is the same as that of the PW, i.e., 500 Hz. In other words, there are 10 REW vectors/frame. Since the SEW receives a large share of the bits available to code the residual, only a small number of bits are available to code the REW. Consequently, it is necessary to prioritize the information contained in the REW and eliminate unimportant components. The REW is converted into a magnitude-phase form, and the REW phase is not explicitly encoded. At the decoder, the REW phase is derived by a weighted combination of a random phase and SEW phase. The most important aspect of the REW magnitude is its level or RMS value. A correct REW level is necessary to ensure that the correct degree of aperiodicity or roughness is created in the reconstructed signal. The spectral shape of REW magnitude is considered to be of secondary importance relative to the REW level. Based on these considerations, the REW magnitude is decomposed onto a gain component and a normalized shape component as follows:

$$g_{rew}(m) = \sqrt{\frac{1}{(2K(m)+2)} \sum_{k=0}^{K(m)} |R(m,k)|^2}, \quad 0 < m \le M, \tag{9.6.1}$$

$$R_{sh}(m,k) = \frac{|R(m,k)|}{g_{rew}(m)}, \quad 0 \le k \le K(m), \quad 0 < m \le M. \tag{9.6.2}$$

9.6.1 REW Gain Quantization

In order to quantize the REW gain, it is noted that is not altogether independent of SEW level. Since the PW is normalized to unity RMS value (eqn. 9.2.6) and since PW is the sum of SEW and REW (eqn. 9.2.8), it follows that if the SEW level is high, REW level must be low and vice versa. In other words, REW level can be estimated from the SEW level. The SEW level is represented by the SEW mean, and the quantized SEW mean is available at the encoder as well as at the decoder. If the REW gain is estimated using the quantized SEW mean, it is only necessary to transmit the estimation error. In this invention, an approach is presented for estimating the REW gain using the SEW mean, resulting in an estimation error vector which can be quantized much more efficiently that the REW gain itself A SEW RMS value is computed from the quantized SEW mean vector $\{\check{S}_q(M,k), 0 \leqq k \leqq K(M)\}$ defined in (9.4.23), as follows:

$$g_{sew}(M) = \sqrt{\frac{1}{(2K(M)+2)} \sum_{k=0}^{K(M)} \check{S}_q^2(M,k)}. \tag{9.6.3}$$

The SEW RMS at frame edges are interpolated to obtain the intermediate values:

$$g_{sew}(m) = \frac{(M-m) g_{sew}(0) + m g_{sew}(M)}{M} \qquad 0 < m < M. \tag{9.6.4}$$

Then, the SEW RMS values are used to estimate the REW gains by $$\hat{g}_{rew}(m) = 0.5(\max(0, \sqrt{(1 - g_{sew}^2(m))}) + \max(0, 1 - g_{sew}(m))). \tag{9.6.5}$$

The REW gain estimation error is obtained by $$e_{grew}(m) = g_{rew}(m) - \hat{g}_{rew}(m) 0 < m \leqq M. \tag{9.6.6}$$

The M -dimensional REW gain estimation error is decimated by a factor of 2:1, in order to reduce VQ complexity and storage. Decimation is performed by dropping the odd-indexed elements. The resulting M/2-dimensional vector is quantized using a 5-bit vector quantizer. The vector quantizer minimizes the distortion $$D_{grew}(l) = \sum_{m=0}^{\frac{M}{2}-1} [e_{grew}(2m+2) - V_{grew}^{l}(m)]^2 \qquad 0 \le l < 32. \tag{9.6.7}$$

If the distortion is minimized for the index l*, the even-indexed elements of the decoded REW gain vector are reconstructed by $$\tilde{g}_{rew}(2m+2)=\hat{g}_{rew}(2m+2)+V_{grew}^{l*}(m) 0<m\leqq M/2. \tag{9.6.8}$$

Due to quantization error, it is occasionally possible to have a negative valued REW gain element. In such a case, it is replaced by a positive value derived from the SEW mean:

$$\tilde{g}_{rew}(2m+2)=0.5\hat{g}_{rew}(2m+2) \text{ if } \hat{g}_{rew}(2m+2)+V_{grew}^{l*}(m)<0 \quad 0\leqq m<M/2 \tag{9.6.9}$$

The odd-indexed elements of the REW gain vector are reconstructed by interpolating between the decoded even-indexed elements:

$$\tilde{g}_{rew}(2m+1) = \frac{(\tilde{g}_{rew}(2m) + \tilde{g}_{rew}(2m+2))}{2} \qquad 0 \le m < \frac{M}{2}. \tag{9.6.10}$$

9.6.2 REW Shape Quantization

The normalized spectral shape of the REW magnitude is given by (9.6.2). The REW magnitude shape determines the distribution of the REW energy across frequency. There are M REW magnitude shape vectors in a frame. The dimensions of these vectors vary with pitch frequency, as in the case of the SEW magnitude vector. The dimensions can be large when the pitch frequency is small. However, since the number of bits available for quantizing REW shape is quite small, it is necessary to reduce this information. It is also desirable to represent REW magnitude shape by a fixed dimensional vector. These objectives can be met by computing an averaged REW magnitude shape vector based on a sub-band averaging process. Both temporal averaging as well as a sub-band averaging across frequency are used to condense the REW shape information. First, each REW magnitude shape vector is reduced to a fixed dimensional vector by averaging across sub-bands. A 5-band sub-band structure is employed resulting in a 5-dimensional REW magnitude shape sub-band vector for each subframe. The five sub-bands are 0–800 Hz, 800–1600 Hz, 1600–2400 Hz, 2400–3200 Hz, and 3200–4000 Hz. Based on this band structure, the corresponding discrete frequency band edges can be computed as follows:

$$k'_{low}(0) = 0, \tag{9.6.11}$$

$$k'_{high}(0) = \frac{800\pi}{8000w_p(N)},$$

$$k'_{low}(1) = \frac{800\pi}{8000w_p(N)},$$

$$k'_{high}(1) = \frac{1600\pi}{8000w_p(N)},$$

-continued $$k'_{low}(2) = \frac{1600\pi}{8000w_p(N)},$$

$$k'_{high}(2) = \frac{2400\pi}{8000w_p(N)},$$

$$k'_{low}(3) = \frac{2400\pi}{8000w_p(N)},$$

$$k'_{high}(3) = \frac{3200\pi}{8000w_p(N)},$$

$$k'_{low}(4) = \frac{3200\pi}{8000w_p(N)},$$

$$k'_{high}(4) = \frac{4000\pi}{8000w_p(N)}$$

The 5-dimensional REW magnitude shape sub-band vector is computed by averaging within each sub-band as follows:

$$\bar{R}(m, i) = \frac{1}{N'_{band}(i)} \sum_{k'_{low}(i)\le k<k'_{high}(i)} R_{sh}(m, k) \quad 0 \le i < 5, 0 < m \le M. \tag{9.6.12}$$

where, $N'_{band}(i)$ is the number of harmonics falling in the $i^{th}$ sub-band. Next, the M REW magnitude shape sub-band vectors in the current frame are averaged to obtain a single average REW magnitude shape sub-band vector per frame. This averaging uses a linear weighting give more weight to the REW shape vector at the edge of the frame.

$$\bar{\bar{R}}(M, i) = \frac{\sum_{m=1}^{M} m\bar{R}(m, i)}{\sum_{m=1}^{M} m} \qquad 0 \le i < 5. \tag{9.6.13}$$

Based on this averaged vector, a piecewise-constant REW magnitude shape vector can be constructed for the frame edge as follows:

$$\check{R}(M,k)=\bar{\bar{R}}(M,i) 0\leqq k\leqq K(M) \text{ and where } 0\leqq i<5 \text{ is such that } k \text{ satisfies } k'_{low}(i)\leqq k<k'_{high}(i) \tag{9.6.14}$$

The 5-dimensional average REW magnitude shape sub-band vector is quantized using 6-bit vector quantization. The codebook contains 5-dimensional code vectors of average REW magnitude shape sub-band vector. During the codebook search process, each 5-dimensional code vector is converted to a K(M)+1-dimensional shape vector using (9.6.14) and compared against the original shape vector:

$$C_{rsh}^{l}(k)=V_{rsh}^{l}(i) 0\leqq k\leqq K(M) \text{ and where } 0\leqq i<5 \text{ is such that } k \text{ satisfies } k'_{low}(i)\leqq k<k'_{high}(i)$$

$$D_{rsh}(l) = \sum_{k=0}^{K(M)} \left(\left[C_{rsh}^{l}(k) - \check{R}(M, k)\right]\right)^2 H_{wlpc}(M, k) \quad 0 \le l < 64. \tag{9.6.15}$$

Note that a spectrally weighted distortion measure is used to obtain better a match in formant regions. If the above distortion is minimized for the index l*, the quantized REW shape vector for the frame edge is reconstructed by $$\tilde{R}_{rsh}(M,k)=V_{rsh}^{l*}(i) 0\leqq k<K(M) \text{ and where } 0\leqq i<5 \text{ is such that } k \text{ satisfies } k'_{low}(i)<k<k'_{high}(i) \tag{9.9.16}$$

The REW magnitude shape vectors for the subframes within the frame are obtained by linearly interpolating between the quantized REW shape vectors at the frame edges:

$$\tilde{R}_{rsh}(m,k)=\frac{(M-m)\tilde{R}_{rsh}(0,k)+m\tilde{R}_{rsh}(M,k)}{M}. \quad 9.6.17$$

Finally, the interpolated REW gain and REW magnitude shape vectors are multiplied to obtain a REW magnitude vector at each subframe within the frame:

$$\tilde{R}_{mag}(m,k)=\tilde{g}_{rew}(m)\tilde{R}_{rsh}(m,k)0\leqq k\leqq K(M),\ 0<m\leqq M \quad 9.6.18$$

This completes the reconstruction of the quantized REW magnitude vectors.

9.7 SEW Phase Modeling using the Voicing Measure

SEW phase is reconstructed using the quantized voicing measure. A SEW phase vector is constructed for each subframe, by combining contributions from the SEW phase of the previous subframe, a random phase and a fixed phase that is obtained from a residual voiced pitch pulse waveform. The voicing measure 100 and a ratio 101 of SEW-to-REW RMS levels determine the weights given to the three components. If the voicing measure 100 is small and the SEW-to-REW RMS ratio 101 is large, indicating a mostly voiced frame, the weights given to the previous SEW phase and the random phase are reduced and the weight given to the fixed phase is increased. This results in a SEW phase that has voiced characteristics and has a smaller change from between the SEW phases of adjacent subframes, during sustained voiced sounds. On the other hand, if the voicing measure 100 is large and the SEW-to-REW RMS ratio 101 is small, indicating a mostly unvoiced frame, the weights given to the previous SEW phase and the random phase are increased and the weight given to the fixed phase is decreased. This results in a SEW phase that is legs voiced and has a larger change from the previous SEW phase.

Figure 5:
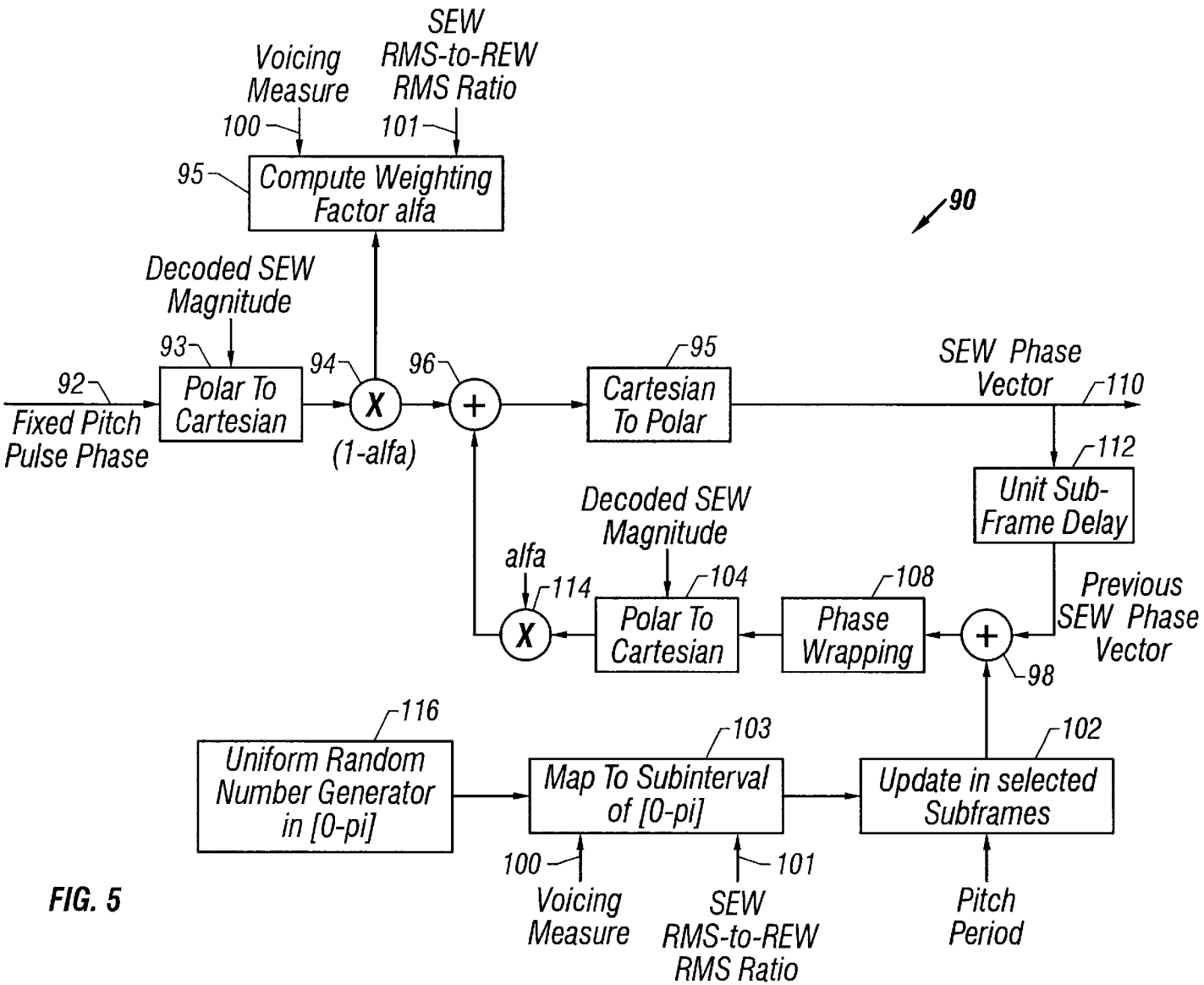
FIG. 5 is a block diagram illustrating the construction of the SEW phase based on the voicing measure.

In order to prevent excessive randomization of the SEW phase during non-periodic segments, the random phase component is not allowed to change every subframe, but is changed after several subframes depending on the pitch period. Also, the random phase component at a given harmonic index alternates in sign in successive changes. FIG. 5 illustrates the SEW phase construction scheme. FIG. 5 shows a block diagram illustrating the construction of the SEW phase based on the voicing measure 100 and pitch period. The phase construction subsystem 90 receives a fixed pitch pulse phase 92. This is combined with the decoded SEW magnitude and converted from polar to Cartesian form in 93, and then mixed with (1-Modified Voicing Measure) in 94. The previous SEW phase vector, obtained as the output of the wait subframe delay 112 is combined with a random component at adder 98. The random component is obtained from a uniform random number generator 116, mapped to a subinterval of [0–π], based on the voicing measure 100 and is updated in selected subframes in 102, depending on the pitch period of the current frame. The output of the adder 98 is phase-wrapped to the interval [–π,π] in 108 and combined with the decoded SEW magnitude in 104, which converts from polar to Cartesian form. This output is mixed with the modified voicing measure in the mixer 114, and the result is summed with the output of the mixer 94 at adder 96. The result is converted from Cartesian to polar form in 95 and the phase component is used as the SEW phase of the current subframe 110.

At the $1^{st}$ subframe in every frame, the rate of randomization for the current frame is determined based on the pitch period. If the subframes are numbered 1,2, . . . , 10, the random phase vector changes occur in the following subframes, depending on the pitch period:

| | |
|---|---|
| 1. Subframes 1, 6 | 120 ≧ pitch period > 90 |
| 2. Subframes 1, 4, 8 | 90 ≧ pitch period > 63 |
| 3. Subframes 1, 4, 6, 9 | 63 ≧ pitch period ≧ 20. |

However, abrupt changes in the update rate of the random phase, i.e., from $1^{st}$ case in the previous frame to the $3^{rd}$ case in the current frame or vice-versa are not permitted. Such cases are modified to the $2^{nd}$ case in the current frame. Controlling the rate at which SEW phase is randomized during aperiodic segments is quite important to prevent artifacts in the reproduced signal, especially in the presence of background noise. If the phase is randomized every subframe, it leads to a fluttering of the reproduced signal. This is due to the fact that such a randomization is not representative of natural signals.

The magnitude of the random phase is determined by a random number generator, which is uniformly distributed over a sub-interval in 0-π radians. The sub-interval is determined based on the voicing measure and a ratio of the SEW RMS level to the REW RMS level at the decoder computed for each subframe. This ratio is computed as follows. Let $G_{sew}(m)$ denote the RMS value of the decoded SEW component for the mth sub-frame and $\overline{g_{rew}}$ denote the average REW level averaged over the current frame, computed by equation 9.9.4. The SEW level to REW level ratio 101 is computed as $$\text{sr_ratio}=\frac{G_{sew}(m)}{\overline{g_{rew}}} \quad 9.7.1$$

The sub-interval 103 of 0–π used for random phase is [0.5*ue*π–ue*π], where ue is determined based on the following rule:

$$ue=\begin{cases}0.5-0.25\text{sr_ratio} & v_q(M)\leq 0.3 \text{ and sr_ratio}<1.0,\\ 0.25-0.0625(\text{sr_ration}-1.0) & v_q(M)\leq 0.3 \text{ and sr_ratio}<3.0,\\ 0.125 & v_q(M)\leq 0.3 \text{ and sr_ratio}\geq 3.0,\\ 1.0 & v_q(M)>0.3 \text{ and sr_ratio}<1.0,\\ 1.0-0.125(\text{sr_ratio}-1.0) & v_q(M)>0.3 \text{ and sr_ratio}<3.0,\\ 0.75 & v_q(M)>0.3 \text{ and sr_ratio}\geq 3.0.\end{cases} \quad 9.7.2$$

Here, $v_q(M)$ denotes the quantized voicing measure for the current frame. The magnitudes of the random phases are uniformly distributed over the interval [0.5*ue*π–ue*π]. Deriving the random phases from such an interval ensures that there is a certain minimal degree of phase randomization at all harmonic indices. This randomly selected phase magnitude is combined with a polarity that reverses in successive changes, to derive a signed random phase component. Let $\{\Psi_{rand}(m, k)\}$ denote the random phase component for the m-th subframe and the k-th harmonic index. This is combined with the SEW phase of the previous subframe $\{\Phi_{sew}(m-1, k)\}$, as follows:

$$\phi(m,k)=\Phi_{sew}(m-1,k)+\Psi_{rand}(m,k),\ 0\leqq k\leqq K(m), 0\leqq m\leqq M. \quad 9.7.4$$

Next, this phase vector is combined with the decoded SEW magnitude vector and converted from polar to Cartesian form. Similarly, the fixed pitch cycle phase is also combined with the decoded SEW magnitude vector and converted from polar to Cartesian form. These resulting complex vectors are combined in a weighted sum, where the weight $\alpha$ 95 is determined by the voicing measure $v_q(M)$ 160 and the sr_ratio 101 as follows:

$$\alpha = \begin{cases} 0.5 - 0.2\,\text{sr_ratio} & v_q(M) \le 0.3 \text{ and sr_ratio} < 1.0, \\ 0.3 - 0.1\,(\text{sr_ratio} - 1.0) & v_q(M) \le 0.3 \text{ and sr_ratio} < 3.0, \\ 0.1 & v_q(M) \le 0.3 \text{ and sr_ratio} \ge 3.0, \\ 1.0 - 0.2\,\text{sr_ratio} & v_q(M) > 0.3 \text{ and sr_ratio} < 1.0, \\ 0.8 - 0.15\,(\text{sr_ratio} - 1.0) & v_q(M) > 0.3 \text{ and sr_ratio} < 3.0, \\ 0.5 & v_q(M) > 0.3 \text{ and sr_ratio} \ge 3.0. \end{cases}$$

The weighted sum of the complex vectors is formed by $$\xi(m,k)=\alpha|S_q(M,k)|e^{j\phi(m,k)}+(1-\alpha)|S_q(M,k)|e^{j\Psi_{fix}(k)}\ 0\le k\le K(m),\ 0<m\le M \qquad 9.7.5$$

The SEW phase is computed as the phase of the resulting weighted sum $\{\xi(m,k)\}$:

$$\Phi_{sew}(m,k) = \arctan\frac{\text{imag}(\xi(m,k))}{\text{real}(\xi(m,k))} \quad 0 \le k \le K(m), \quad 0 < m \le M. \qquad 9.7.6$$

Here, imag(.) denotes the imaginary part of a complex entity and real(.) denotes the real part of a complex entity. It was found that combining the random and fixed phase components in the cartesian rather than in the polar domain is quite important to obtaining a satisfactory phase vector for the SEW component.

9.8 Reconstruction of SEW

The reconstructed SEW magnitude $\{|S_q(M,k)|\}$ at frame edge is linearly interpolated across the frame to obtain a SEW magnitude for each subframe.

$$|S_q(m,k)| = \frac{(M-m)|S_q(0,k)| + m|S_q(M,k)|}{M} \qquad 9.8.1$$

The interpolated SEW magnitudes are combined with the reconstructed SEW phases to reconstruct the complex SEW vectors at every subframe:

$$S_q(m,k)=|S_q(m,k)|e^{j\Phi_{sew}(m,k)}\ 0\le k\le K(m),\ 0<m<M. \qquad 9.8.2$$

9.8.1 Filtering of the SEW component

The reconstructed complex SEW component is passed through a low pass filter to reduce any excessive variations and to be consistent with the SEW extraction process at the encoder. The SEW at the encoder has a nominal evolutionary bandwidth of 25 Hz. However, due to modeling errors and the random component in SEW phase it is possible for the SEW at the decoder to have excessively rapid variations. This results in a decoded SEW magnitude that has a evolutionary bandwidth that is higher than 25 Hz. This is undesirable since it produces speech that lacks naturalness during voiced sounds. To overcome this problem, SEW low pass filtered. However, it is not practical to use the linear phase FIR filters that were used at the encoder, since these introduce a delay of one frame. Instead, the low pass filtering is approximated by a second order IIR filter. The filter transfer function is given by $$H_{sew}(z) = \frac{1 + b_1 z^{-1} + b_2 z^{-2}}{1 + a_1 z^{-1} + a_2 z^{-2}}, \qquad 9.8.3$$

where, $$b_1 = -1.4\cos\left(\frac{40\pi}{250}\right), \quad b_2 = 0.7^2,$$

$$a_1 = -1.8\cos\left(\frac{10\pi}{250}\right), \quad a_2 = 0.9^2$$

The filter as defined above has a complex pole at a frequency of $$\frac{10\pi}{250}$$

and a radius of 0.9, and a complex zero at a frequency of $$\frac{40\pi}{250}$$

and a radius of 0.7, to produce a low pass filter characteristic with a cut off of 25 Hz. The SEW filtering operation is represented by $$S_{q1}(m,k)=S_q(m,k)+b_1S_q(m-1,k)+b_2S_q(m-2,k)-a_1S_{q1}(m-1,k)-a_2S_{q1}(m-2,k)\ 0\le k\le K(m),\ 0<m\le M. \qquad 9.8.4$$

The filtering operation modifies the SEW magnitude as well as the SEW phase. Modification of the SEW phase is desirable to limit excessive variations due to the random phase component. However, SEW magnitude quantization is more accurate, since a larger number of bits have been used in its quantization. Any modification to SEW magnitude may reduce its accuracy. To overcome this problem, after the filtering operation, the SEW magnitude is reset to the value at the input to the filter:

$$S_{q2}(m,k) = S_{q1}(m,k)\left|\frac{S_q(m,k)}{S_{q1}(m,k)}\right|, \qquad 9.8.5$$

$$0\le k\le K(m),\ 0<m\le M.$$

The resulting SEW vector $\{S_{q2}(m,k)\}$ has the same magnitude as the unfiltered SEW vector $\{S_q(m,k)\}$ and the phase of the filtered SEW vector $\{S_{q1}(m,k)\}$.

9.9 REW Phase Construction

The REW phase vector is not explicitly encoded. The decoder generates a complex REW vector by high pass filtering a weighted sum of the complex SEW vector and a complex white noise signal. The weights of SEW and white noise are dependent on the average REW gain value for that frame. The filter is a single-zero, two-pole filter. The zero is adjusted based on SEW and REW levels. The complex pole frequency is fixed at 25 Hz (assuming a 50 Hz SEW sampling rate). The pole radius varies from 0.2 to 0.60, depending on the decoded voicing measure. As the periodicity of the frame increases (as indicated by a lower voicing measure), the pole moves closer to the unit circle. At the same time, at the filter input, the weight of the SEW component increases relative to that of the white noise component. This has the effect of creating a REW component having more correlation with SEW and with more of its energy at lower frequencies. At the same time, the presence of the real zero ensures that the REW energy diminishes below 25 Hz. The overall result is to create a REW component that (i) has its energy distributed in a manner consistent with the REW extraction process at the encoder and with the relative levels of REW and SEW components, and (ii) to create a correlation between the REW and the SW for voiced frames. At the filter output, the REW magnitude is restored to its value at the filter input by a magnitude scaling operation. The REW phase construction scheme is illustrated in FIG. 6.

Figure 6:
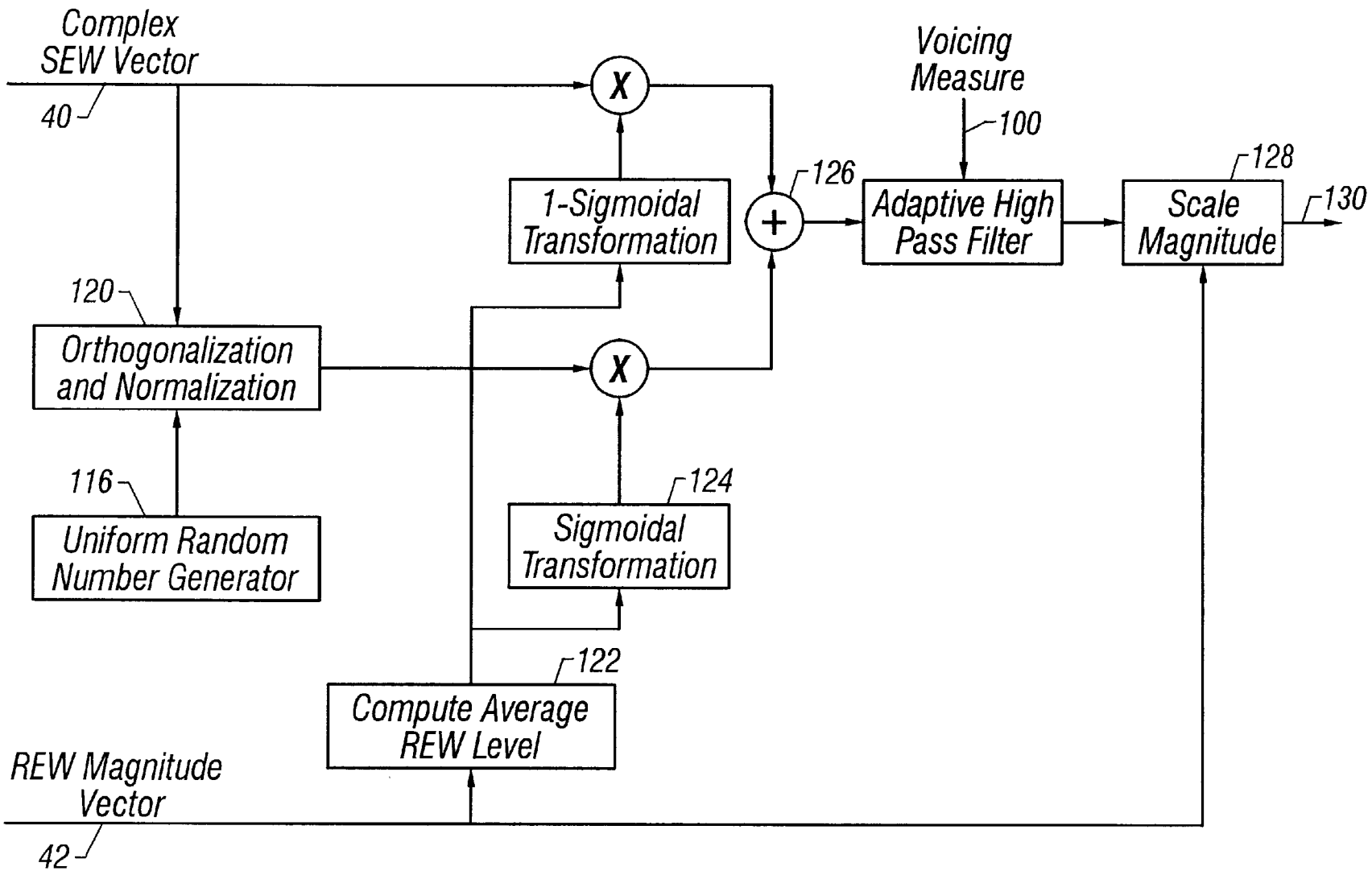
FIG. 6 is a block diagram illustrating the construction of the REW phase.

FIG. 6 is a block diagram illustrating the construction of the REW phase from the complex SEW vector 40 and the REW magnitude vector 42. A complex random component is generated by the uniform random generator of block 116 is orthogonalized and normalized with respect to the complex SEW vector 40 at block 120. The average REW level is computed by block 122, which undergoes two complementary sigmoidal transformations. The two transformed REW levels are mixed with the SEW vector 40 and the random component of block 120 and summed at adder 126. The complex output of the adder is passed through an adaptive pole-zero high pass filter. The voicing measure is used to adjust the radius of the pole of the high pass filter. The magnitude of the filter output is scaled at block 128 to match the REW magnitude vector, resulting in the complex REW vector output signal 130.

The transfer function of the high pass filter is given by $$H_{rew}(z) = \frac{1 + dz^{-1}}{1 + c_1 z^{-1} + c_2 z^{-2}}. \qquad 9.9.1$$

The filter has a real zero which is adjusted based on the SEW level to REW level ratio. Let $G_{sew}(m)$ denote the RMS value of the SEW component and $\text{avg_g}_{rew}$ (see equation. 9.9.4) denote the average REW level. A SEW level to REW level ratio is computed as $$\text{sr_ratio} = \frac{G_{sew}(m)}{\text{avg_g}_{rew}}.$$

Then the zero is selected according to the following rule:

-0.9 v.(M)>0.3, $$d = \begin{cases} -0.9 & v_q(M) > 0.3, \\ -0.9 & v_q(M) \le 0.3 \text{ and sr_ratio} < 1.25, \\ -0.9 + 0.2(\text{sr_ratio} - 1.25) & v_q(M) \le 0.3 \text{ and sr_ratio} < 2.0, \\ -0.75 & v_q(M) \le 0.3 \text{ and sr_ratio} < 3.25 \\ -0.75 - 0.2(\text{sr_ratio} - 3.25) & v_q(M) \le 0.3 \text{ and sr_ratio} < 4.0, \\ -0.9 & v_q(M) \le 0.3 \text{ and sr_ratio} \ge 4.0. \end{cases}$$

Thus, for aperiodic sounds or for periodic sounds with low SEW-to-REW level ratio, a strong (close to unit circle) is used, thereby suppressing the low frequency component in REW phase. As the SEW-to-REW level ratio increases, the zero becomes weaker, allowing more low frequency, i.e., SEW signal to determine the REW phase. As a result, as SEW becomes stronger relative to REW, REW phase varies more slowly and also becomes more correlated with SEW. However, as the SEW-to-REW level continues to increase beyond 3.25, the zero tends to becomes stronger. This ensures that for frames with very high levels of SEW, REW does not become completely periodic; instead, a certain minimal degree of randomness is preserved in the REW phase.

The denominator parameters are derived from a complex pole pair, whose angle is fixed at $$\frac{25\pi}{250},$$

but whose radius is modified according to the voicing measure. This results in the following denominator parameters:

$$c_1 = -2(0.2 + 0.4(1 - v_q(M))\cos\left(\frac{25\pi}{250}\right), \qquad 9.9.2.$$

$$c_2 = (0.2 + 0.4(1 - v_q(M))^2.$$

The radius of the complex pole-pair varies from 0.2 (roughly high pass from 25 Hz) to 0.6 (roughly bandpass around 25 Hz) as the voicing measure varies from 1 (completely unvoiced) to 0 (completely voiced).

The input to the filter is derived by a weighted combination of the complex SEW and a white noise signal. This can be expressed as $$R_{ip}(m,k) = \alpha_{rew}(m,k)S_q(m,k) + (1-\alpha_{rew}(m,k))G_{sew}(m)r_{rand}(m,k),$$
$$0 < m \le M,\ 0 \le k \le K(m) \qquad 9.9.3$$

Here, $\{r_{rand}(m,k)\}$ is a zero mean, unit variance uncorrelated random sequence, uniformly distributed over [−0.5–0.5] that is orthogonal to $S_q(m,k)$. Such a sequence is easily derived by Gram-Schmidt orthogonalization procedure. $G_{sew}(m)$ is the RMS value of the SEW component, and is used to make the RMS value of the random component equal to that of SEW. The weight factor $\alpha_{sew}$ is computed based on the average REW gain:

$$\text{avg_g}_{rew} = \frac{1}{M}\sum_{m=1}^{M} \tilde{g}_{rew}(m). \qquad 9.9.4$$

$\{\alpha_{sew}(m,k)\}$ is obtained by $$\alpha_{sew}(m, k) = \frac{1}{1 + e^{15(\text{avg_g}_{rew} - 0.65)}}\left(1.25 - \frac{0.5k}{K(m)}\right), \qquad 9.9.5$$

$$0 < m \le M,\ 0 \le k \le K(m)$$

$\alpha_{sew}(m,k)$ is limited to the range 0–1. As the REW level increases from a low value (voiced) to a high value (unvoiced), the SEW weight factor $\alpha_{sew}$ decreases from near 1 (mostly SEW, very little random component) to nearly 0 (very little SEW, mostly random component). Further, lower frequency harmonics have a lower random component than higher frequency harmonics. The filtering operations are specified by $$R_{q1}(m,k) = R_{ip}(m,k) + d_1 R_{ip}(m-1, k) + d_2 R_{ip}(m-2,k) - c_1 R_{q1}(m-1,k) -$$
$$c_2 R_{q1}(m-2,k),\ 0 < m \le M,\ 0 \le k \le K(m) \qquad 9.9.6$$

The filtering operation produces a REW component that roughly conforms to the evolutionary characteristics of the REW at the encoder. However, the magnitude the filtered REW is arbitrary. It is necessary to set the magnitude to the quantized and interpolated REW magnitude. This is accomplished by the following magnitude scaling operation:

$$R_q(m,k) = R_{q1}(m,k)\frac{\tilde{R}_{mag}(m,k)}{|R_{q1}(m,k)|}, \quad 0 < m \le M, \quad 0 \le k \le K(m). \qquad 9.9.7$$

The resulting REW vector $\{R_q(m,k)\}$ has the decoded REW magnitude and the phase as determined by the REW filtering operation.

9.10 Reconstruction of the PW Sequence

Figure 7:
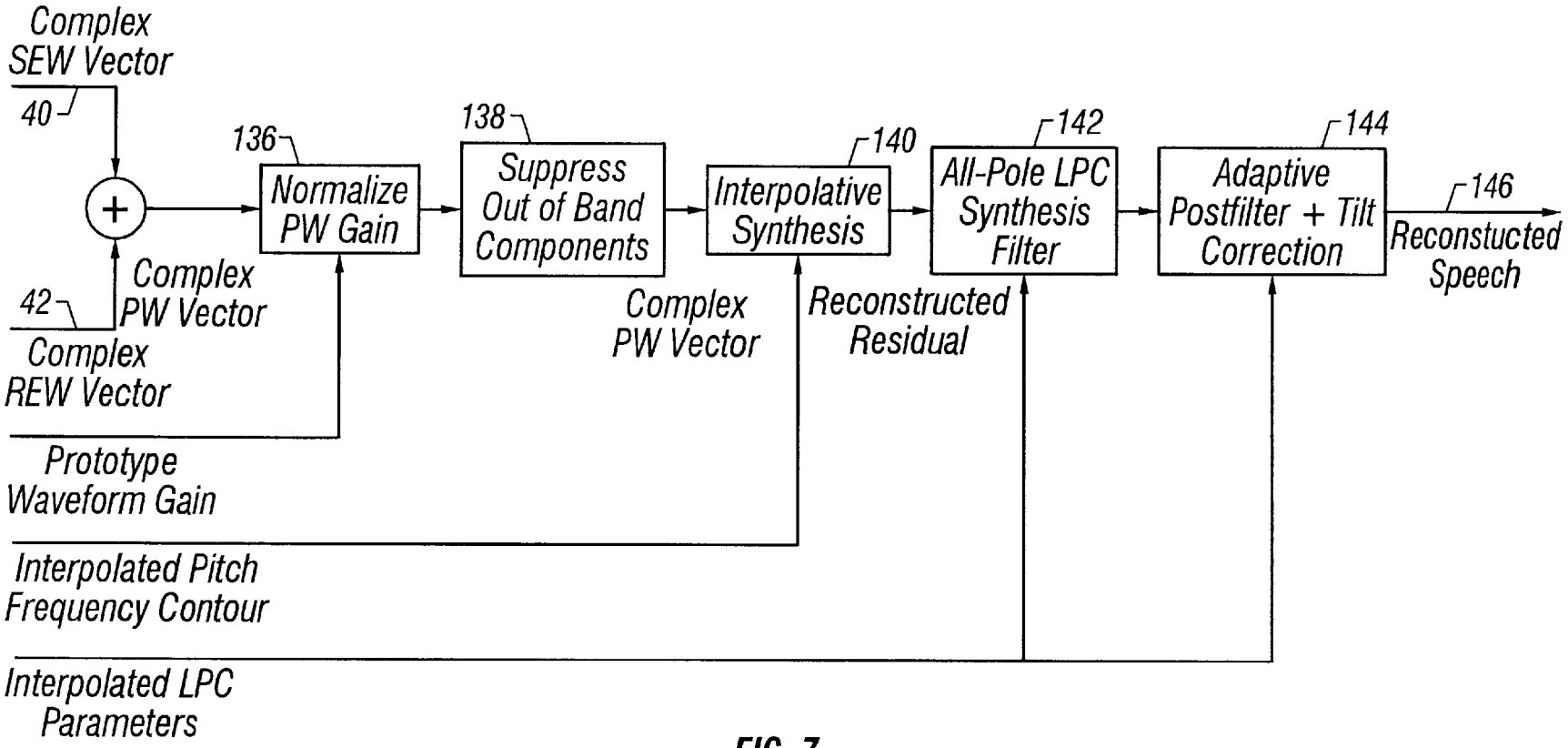
FIG. 7 is a block diagram illustrating the reconstruction of the PW and speech signal.

FIG. 7 illustrates the reconstruction of the PW sequence, the reconstruction of the residual signal and the reconstruction of the speech signal. FIG. 7 is a block diagram illustrating the reconstruction of the prototype waveform and speech signals from which reconstructive speech is decoded. The complex SEW vector 40 is summed with the complex REW vector 42 to provide a normalized prototype word gain at block 136 from which suppression of out-of-band components are removed at block 138 to present the complex PW vector for interpolative synthesis at block 140 with the interpolated pitch frequency contour signal. The reconstructed residual signal is filtered with an all pole LPC synthesis filter 142 with the interpolated LPC parameters, and adaptive postfiltering and tilt correction is provided at block 144 to generate the output reconstructed speech 146. The PW is reconstructed by adding the reconstructed SEW and REW components:

$$P_{q1}(m,k)=S_{q3}(m,k)+R_q(m,k),\ 0<m\leqq M,\ 0\leqq k\leqq K(m). \qquad 9.10.1$$

The out-of-band components, i.e., components below 80 Hz and above 3400 Hz, are attenuated in a piecewise linear manner:

$$P_{q2}(m,k) = \begin{cases} 0 & k=0, & 0<m\le M, \\ P_{q1}(m,k) & 1 \le \frac{kw_p 4000}{\pi} \le 3400, & 0<m\le M, \\ P_{q1}(m,k)\frac{(\pi - kw_p)4000}{80\pi} & 3400 < \frac{kw_p 4000}{\pi}, & 0<m\le M. \end{cases} \qquad 9.10.2$$

Finally, the RMS value of the PW is restored to the value given by the decoded PW gain from (9.3.3) and (9.3.4).

$$\tilde{P}(m,k)=\tilde{G}_{pw}(m)P_{q2}(m,k)\ 0<m\leqq M,\ 0\leqq k\leqq K(m). \qquad 9.10.3$$

9.11 Adaptive Bandwidth Broadening

In the case of frames that do not contain active speech, it is desirable to modify the LPC parameters so that formant bandwidths are broadened. Sharp spectral resonances during inactive frames, especially for certain background noise conditions leads to annoying artifacts. This can be mitigated by a mild degree of bandwidth broadening that is adapted based on the decoded VAD flag and the decoded voicing measure. The bandwidth expansion is zero during active, periodic frames and progressively increases as the periodicity decreases and the likelihood of voice activity decreases. Let $v_f$, $v_f(-1)$, $v_f(-2)$, $v_f(-3)$ denote the VAD flags that were received during the current frame and the 3 preceding frames in that order. Note that since the VAD flag is transmitted 2 frames ahead of the frame currently being synthesized, the VAD flag that corresponds to the current frame is $v_f(-2)$. A VAD likelihood parameter is computed by summing the four VAD flags:

$$v_L=v_f+v_f(-1)+v_f(-2)+v_f(-3). \qquad 9.11.1$$

Since the VAD flags are 0 or 1, VAD likelihood is an integer in the range [0–4].

The $i_{vm}$ denote the quantizer index for the voicing measure. Since the voicing measure is quantized using 3 bits, $i_{vm}$ is and integer in the range [0–7]. Also, lower values of $i_{vm}$ correspond to lower values of the voicing measure as illustrated by the following inverse quantization table for the voicing measure:

| | $i_{vm}$: | | | | | | | |
|---|---|---|---|---|---|---|---|---|
| | 0 | 1 | 2 | 3 | 4 | 5 | 6 | 7 |
| Decoded Voicing Measure: | 0.1 | 0.15 | 0.20 | 0.25 | 0.40 | 0.55 | 0.70 | 0.85 |

The bandwidth expansion factor is derived using the voicing likelihood and the voicing measure index according to the following matrix:

| | $v_L$ | | | | |
|---|---|---|---|---|---|
| $i_{vm}$ | 4 | 3 | 2 | 1 | 0 |
| 0 | 1.00 | 1.00 | 1.00 | 1.00 | 1.00 |
| 1 | 1.00 | 1.00 | 1.00 | 1.00 | 1.00 |
| 2 | 1.00 | 1.00 | 1.00 | 1.00 | 1.00 |
| 3 | 1.00 | 1.00 | 1.00 | 1.00 | 1.00 |
| 4 | 1.00 | 1.00 | 1.00 | 1.00 | 0.96 |
| 5 | 1.00 | 1.00 | 1.00 | 0.96 | 0.92 |
| 6 | 1.00 | 1.00 | 0.96 | 0.92 | 0.88 |
| 7 | 1.00 | 0.96 | 0.92 | 0.88 | 0.80 |

Let $\lambda$ be the bandwidth expansion factor from the above matrix for the voicing measure index $i_{vm}$ and the VAD likelihood $v_L$. Then bandwidth expanded LPC parameters are computed as follows:

$$a'_l(m)=a_l(m)\lambda^l,\ l=0,1,\ldots,L,\ 0<m\leqq M. \qquad 9.11.2$$

9.12 Reconstruction of the Residual Signal

The residual signal is constructed from the PW using an interpolative frequency domain synthesis process. In this process, the PW are linearly interpolated to obtain an interpolated PW for each sample within the subframe. At each sample instant, an inverse DFT is used to compute the time-domain residual sample corresponding to that instant. A linear phase shift is included in this inverse DFT, so that successive samples are advanced within the pitch cycle by the phase increments according to the linearized pitch frequency contour.

The synthesis operation for the $m^{th}$ subframe within the current frame can by represented by $$\tilde{e}((m-1)N_s+n) = \frac{1}{(2K(m)+1)N_s} \sum_{k=0}^{2K(m)} \left[(N_s-n)\tilde{P}(m-1,k)+n\tilde{P}(m,k)\right]e^{j\theta((m-1)N_s+n)k}, \qquad 9.12.1$$

$$0\leqq n<N_s,\ 0<m\leqq M,\ 0\leqq k\leqq K(m)$$

Here, $\theta(n)$ is the phase of the fundamental harmonic at the $n^{th}$ sample of the $m^{th}$ subframe. It is obtained as the sum of the initial phase at the end of the previous subframe and the trapezoidal integration of the pitch frequency contour:

$$\theta((m-1)N_s+n)=\theta((m-1)N_s-1)+\sum_{i=0}^{n}\frac{w_p((m-1)N_s+i-1)+w_p((m-1)N_s+i)}{2},\quad 0\le n<N_s. \tag{9.12.2}$$

The resulting residual signal $\{\tilde{e}(n)\}$ is processed by an all-pole LPC synthesis filter, constructed using the decoded and interpolated LPC parameters, resulting in the reconstructed speech signal.

$$\tilde{s}((m-1)N_s+n)=\tilde{e}((m-1)N_s+n)-\sum_{l=1}^{L}\alpha'_l(m-1)\tilde{s}((m-1)N_s+n-l),\quad 0\le n<\frac{N_s}{2},\quad 0<m\le M. \tag{9.12.3}$$

$$\tilde{s}((m-1)N_s+n)=\tilde{e}((m-1)N_s+n)-\sum_{l=1}^{L}\alpha'_l(m)\tilde{s}((m-1)N_s+n-l),\quad \frac{N_s}{2}\le n<N_s,\quad 0<m\le M. \tag{9.12.4}$$

The first half of the subframe is synthesized using the LPC parameters at the left edge of the subframe and the second half by the LPC parameters at the right edge of the subframe. This is done to be consistent with the manner in which the interpolated LPC parameters are computed.

The reconstructed speech signal is processed by an adaptive postfilter to reduce the audibility of the degradation due to quantization. A pole-zero postfilter with an adaptive tilt correction [see, e.g., J.-H. Chen and A. Gersho, "Adaptive Postfiltering for Quality Enhancement of Coded Speech", IEEE Transactions on Speech and Audio Processing, Vol. 3, No. 1, pp 59–71, January 1995] is employed. As during speech reconstruction, the first half of the subframe is postfiltered by parameters derived from the LPC parameters at the left edge of the subframe. The second half of the subframe is postfiltered by the parameters derived from the LPC parameters at the right edge of the subframe. These two postfilter transfer functions are specified respectively by $$H_{pf1}(z)=\frac{\sum_{l=0}^{L}\alpha'_l(m-1)\beta^l_{pf}z^{-l}}{\sum_{l=0}^{L}\alpha'_l(m-1)\alpha^l_{pf}z^{-l}}\quad\text{and} \tag{9.12.5}$$

$$H_{pf2}(z)=\frac{\sum_{l=0}^{L}\alpha'_l(m)\beta^l_{pf}z^{-l}}{\sum_{l=0}^{L}\alpha'_l(m)\alpha^l_{pf}z^{-l}} \tag{9.12.6}$$

The pole-zero postfiltering operation for the first half of the subframe is represented by $$\tilde{s}_{pf1}((m-1)N_s+n)=\sum_{l=1}^{L}\alpha'_l(m-1)\beta^l_{pf}\tilde{s}((m-1)N_s+n-l)-\sum_{l=1}^{L}\alpha'_l(m-1)\alpha^l_{pf}\tilde{s}_{pf1}((m-1)N_s+n-l),\quad 0\le n<\frac{N_s}{2},\quad 0<m\le M. \tag{9.12.7}$$

The pole-zero postfiltering operation for the second half of the subframe is represented by $$\tilde{s}_{pf1}((m-1)N_s+n)=\sum_{l=1}^{L}\alpha'_l(m)\beta^l_{pf}\tilde{s}((m-1)N_s+n-l)-\sum_{l=1}^{L}\alpha'_l(m)\alpha^l_{pf}\tilde{s}_{pf1}((m-1)N_s+n-l),\quad \frac{N_s}{2}\le n<N_s,\quad 0<m\le M. \tag{9.12.8}$$

Here, $\alpha_{pf}$ and $\beta_{pf}$ are the postfilter parameters. These must satisfy the constraint:

$$0\le\beta_{pf<\alpha pf}\le 1.$$

A typical choice for these parameters is $\alpha_{pf}=0.9$ and $\beta_{pf}=0.75$.

The postfilter introduces a low pass frequency tilt to the spectrum of the filtered speech, which leads to a muffling of postfiltered speech. This is corrected by a tilt-correction mechanism, which estimates the spectral tilt introduced by the postfilter and compensates for it by a high frequency emphasis. A tilt correction factor is estimated as the first normalized autocorrelation lag of the impulse response of the postfilter. Let $v_{pf1}$ and $v_{pf2}$ be the two tilt correction factors computed for the two postfilters in (9.11.5) and (9.11.6) respectively. Then the tilt correction operation for the two half subframes are as follows:

$$\tilde{s}_{pf}((m-1)N_s+n)=\tilde{s}_{pf1}((m-1)N_s+n)-\tilde{s}_{pf1}((m-1)N_s+n)-v_{pf1}\tilde{s}_{pf1}((m-1)N_s+n-1)\quad 0\le n<\frac{N_s}{2},\quad 0<m\le M \tag{9.12.9}$$

$$\tilde{s}_{pf}((m-1)N_s+n)=\tilde{s}_{pf1}((m-1)N_s+n)-v_{pf2}\tilde{s}_{pf1}((m-1)N_s+n-1)\quad \frac{N_s}{2}\le n<N_s,\quad 0<m\le M \tag{9.12.10}$$

The postfilter alters the energy of the speech signal. Hence it is desirable to restore the RMS value of the speech signal at the postfilter output to the RMS value of the speech signal at the postfilter input. The RMS value of the postfilter input speech for each half of the $m^{th}$ subframe is computed by:

$$\sigma_{prepf1}(m)=\sqrt{\frac{2}{N_s}\sum_{n=0}^{\frac{N_s}{2}-1}\tilde{s}^2((m-1)N_s+n)}\quad 0<m\le M. \tag{9.12.11a}$$

-continued $$\sigma_{prepf2}(m) = \sqrt{\frac{2}{N_s}\sum_{n=\frac{N_s}{2}}^{N_s-1} \tilde{s}^2((m-1)N_s+n)} \quad 0 < m \le M. \qquad 9.12.12b$$

The RMS value of the postfilter output speech for each half of the $m^{th}$ subframe is computed by:

$$\sigma_{pf1}(m) = \sqrt{\frac{2}{N_s}\sum_{n=0}^{\frac{N_s}{2}-1} \tilde{s}_{pf}^2((m-1)N_s+n)} \quad 0 < m \le M. \qquad 9.12.13a$$

$$\sigma_{pf2}(m) = \sqrt{\frac{2}{N_s}\sum_{n=\frac{N_s}{2}}^{N_s-1} \tilde{s}_{pf}^2((m-1)N_s+n)} \quad 0 < m \le M. \qquad 9.12.12b$$

An adaptive gain factor is computed for each half of the $m^{th}$ subframe by low pass filtering the ratio of the RMS value at the input to the RMS value at the output:

$$g_{pf}((m-1)N_s+n) = \begin{cases} 0.9g_{pf}((m-1)N_s+n-1) + 0.1\left(\frac{\sigma_{prepf1}(m)}{\sigma_{pf1}(m)}\right), & 0 \le n < \frac{N_s}{2}, \\ 0.9g_{pf}((m-1)N_s+n-1) + 0.1\left(\frac{\sigma_{prepf2}(m)}{\sigma_{pf2}(m)}\right), & \frac{N_s}{2} \le n < N_s. \end{cases} \qquad 9.12.14$$

The postfiltered speech is scaled in each half of the $m^{th}$ subframe by the corresponding gain factor as follows:

$$s_{out}((m-1)N_s+n) = g_{pf}((m-1)N_s+n)\tilde{s}_{pf}((m-1)N_s+n), 0 \le n < N_s, \quad 0 < m \le M. \qquad 9.12.15$$

The resulting scaled postfiltered speech signal $\{s_{out}(n)\}$ constitutes the output speech of the decoder.

9.13 Error Concealment Techniques for Masking Transmission Errors in Encoded Parameters The error concealment procedure consists of "bad frame masking" that takes place when we receive a bad frame and "bad frame recovery" that takes place in the first good frame after one or more consecutive bad frames. The error concealment procedure that we have used utilizes the interdependencies of the various parameters and their quantization schemes as well as their staggered use in the synthesis of speech by the FDI decoder to effectively mask bad frames and recover from them in a smooth manner.

We assume that a reliable bad frame indicator (BFI) flag is provided with every compressed speech packet. A common way in which such a BFI flag is generated is by use of Cyclic Redundancy Check (CRC) parity bits. CRC parity bits are computed for the compressed speech packet and transmitted along with the packet. At the receive side, the CRC parity bits are recomputed and compared with the received parity bits. The BFI flag is set if there is any difference else it is reset.

The error concealment procedure for every parameter is described in the following sections. It is important to note that the error concealment follows the same sequence as decoding of the various parameters, i.e., VAD likelihood, LSF's, pitch, SEW phase, SEW magnitude, REW magnitude gain and REW magnitude shape. In addition to the BFI flag for the current frame and the last frame BFI (LBFI) flag, a bad frame counter (BFC) is also employed in the error concealment procedure. BFC is the number of consecutive bad frames received thus far and is reset to zero after two consecutive good frames at the beginning of the frame prior to all decoder operations.

9.13.1 VAD likelihood

The VAD likelihood for the current speech frame that is being synthesized is computed as the sum of the most recently received VAD flag and the past three VAD flags received in the earlier frames. If we denote the VAD flag and the VAD likelihood corresponding to frame k by $v_f(k)$ and $v_L(k)$ respectively, then we can express the VAD likelihood for the current speech frame k−2 that is being synthesized as follows:

$$v_L(k-2) = v_f(k-3) + v_f(k-2) + v_f(k-1) + v_f(k)$$

The VAD likelihood for the current speech frame is used to adaptively bandwidth broaden the interpolated LP filter coefficients during periods of inactivity and/or low degree of voicing. In the event of a bad frame indication, the masking procedure simply replaces the most recently received VAD flag from the corrupted speech packet by 1, i.e., $$v_f(k) = 1$$

This procedure retains or increases the VAD likelihood which in turn ensures that the degree of adaptive bandwidth broadening is no more than warranted. If the adaptive bandwidth broadening is excessive then the synthesized speech may be distorted and it is therefore important to avoid this. If the degree of adaptive bandwidth broadening is less than warranted then the background noise may be distorted but not the speech itself It is therefore safer to err on this side. There is no explicit bad frame recovery associated with this parameter.

9.13.2 Line Spectral Frequencies (LSF)

The LSF's are decoded from the received speech packet by first reconstructing the error vector e(k) using inverse VQ and then applying the correction due to backward prediction and the long term DC value $L_{dc}$ as follows:

$$L(k) = L_{dc} + \alpha L(k-1) + e(k)$$

Here, $\alpha$ is the fixed predictor and equals 0.5 and L(k−1) is the state variable of the first order predictor. After the LSF's are reconstructed, they are ordered and stabilized to form L (k) prior to interpolation and conversion to filter coefficients. Finally, the state variable of the first order predictor is updated as follows:

$$L'(k) = L''(k) - L_{dc}$$

It needs to be emphasized that the speech is synthesized for frame k−2 uses the filter coefficients that were derived after interpolating L"(k−2) and L"(k−1).

In the event of a bad frame indication, the error vector is not reconstructed by inverse VQ using the indices from the corrupted speech packet. Instead it is zeroed out and the fixed predictor is changed from $\alpha=0.5$ to $\alpha=\alpha_{bf}=0.9$, i.e., $$L(k) = L_{dc} + \alpha_{bf} L'(k-1)$$

The intent here is to reconstruct the LSF's solely on the basis of its previous history and not rely on the received LSF VQ indices in the corrupted speech packet. In the event of several consecutive bad frames, the reconstructed LSF's would slowly converge to the long term DC value $L_{dc}$. Since the speech that is synthesized for frame k−2 uses the filter coefficients derived after interpolating L"(k−2) and L"(k−1), the effects of bad frame masking of the LSF's L"(k) is felt only in the synthesis of speech in the next frame k−1.

The bad frame recovery focusses on a smooth transition of the LSF parameters. Since the previous LSF's L"(k−1)

may be erroneous, we reconstruct them as well in such a way that the following "smoothness" criteria is met:

$$L''(k-1)=(L''(k-2)+L''(k))/2$$

In most cases, the ordering and stabilization operations do not alter the LSF's. These steps are purely precautionary to ensure that we never encounter unstable filter coefficients. For this reason, we can ignore the effects of these operations and can express the above criteria as follows:

$$L(k-1)=(L''(k-2)+L(k))/2$$

Such a criteria is satisfied by reconstructing L(k) and L(k−1) as follows:

$$L(k) = L_{dc} + \left(\frac{\alpha}{2-\alpha}\right)\cdot L'(k-2) + \left(\frac{2}{2-\alpha}\right)\cdot e(k)$$

$$L(k-1) = L_{dc} + \left(\frac{1}{2-\alpha}\right)\cdot L'(k-2) + \left(\frac{1}{2-\alpha}\right)\cdot e(k)$$

The precautionary ordering and stabilization procedure is carried out on both L(k) and L(k−1) which results in L"(k) and L"(k−1). These are then interpolated and then converted to filter coefficients for synthesis. Finally, the state variable of the first order predictor is updated in the usual way, i.e., $L'(k)=L''(k)-L_{dc}$. We note here that when we have a single bad frame, then the bad frame recovery procedure provides a very effective solution in ensuring a smooth spectral transition. Furthermore, this recovery takes place before one can perceive any ill-effects due to the bad frame masking procedure.

9.13.3 Open Loop Pitch

The open loop pitch period lies in the range [20, 120] and it is encoded using a 7 bit index in the compressed speech packet. At the decoder, this 7 bit index is used to extract the open loop pitch period $P_k$ for frame k which is then used to determine the interpolated pitch frequency contour for frame k−1. As in the LSF's, it needs to be emphasized that the speech is synthesized for frame k−2 uses the open loop pitch frequency contour that is derived by interpolating the open loop pitch frequency for frames k−2 and k−1.

In the event of a bad frame indication, the open loop pitch period $P_k$ for frame k is not obtained from the corrupt compressed speech packet but is simply replicated as the previous pitch period, i.e., $P_k=P_{k-1}$. Again, we note that the effects of masking this parameter would not be perceived in the synthesis of current frame k−2 but in the next frame k−1.

The bad frame recovery procedure is different in the case of recovery from a single bad frame (BFC=1) than from multiple consecutive bad frames (BFC>1). For BFC>1, the old pitch period $P_{k-1}$ is set to the current pitch period $P_k$, i.e., $P_{k-1}=P_k$. For BFC=1, the old pitch period $P_{k-1}$ is obtained by interpolating the pitch periods $P_{k-2}$ and $P_k$, i.e., $P_{k-1}=(P_k+P_{k-2})/2$, if they are within close proximity of each other, i.e., $|P_k-P_{k-2}|<6$. If the pitch periods $P_{k-2}$ and $P_k$ are not within close proximity of each other, $P_{k-1}$ is obtained as the minimum of the two pitch periods $p_{k-2}$ and $P_k$. We note here that just as in the case of LSF's that when we have a single bad frame, i.e., BFC=1, the bad frame recovery procedure is very effective in ensuring a smooth evolution of pitch and takes place before one can perceive any ill-effects due to the bad frame masking procedure.

9.13.4 PW Gain

The PW gain is vector quantized using a 8 bit 5 dimensional VQ. At the decoder, a 5 dimensional gain vector is decoded from the received 8 bit index. It is then interpolated to form a ten dimensional gain vector to provide PW gains for all ten subframes.

In the event of a bad frame indication, the 5 dimensional PW gain vector is obtained by gradually decaying a gain estimate. For the first bad frame, i.e., BFC=1, this gain estimate is computed as the minimum of the average PW gain of the last frame and the average PW gain of the last two frames. Denoting this gain estimate as $\hat{g}_{k-2}$, we can form the 5 dimensional PW gain vector as follows:

$$g_{k-2}=\hat{g}_{k-2}\cdot[\alpha\ \alpha^2\alpha^3\alpha^4\alpha^5]$$

where the decay factor a is chosen to be 0.98. For BFC>1, the gain estimate is chosen to be the last element in the previous PW gain vector. In addition, we choose the decay factor α to be 0.95 for BFC>1. Eventually as BFC→∞, the elements of the PW gain vector decay to zero.

The bad frame recovery limits the gain in the first good frame after one or more bad frames to within a bound. This bound $g_B(i, k-2)$ for the i -th element (i ranging from 1 to 5) of the PW gain vector for the current speech frame k−2 that is being synthesized is computed as follows:

$$g_B(i,k-2)=\sigma\cdot g_B(i-l,k-2)$$

where $g_B(0,k-2)$ is initialized to be the maximum of the last element of the previous PW gain vector $g_{k-3}(5)$ and a small threshold 0.1. The gain bound growth factor or is derived such that there is effectively no limit for the last element of the current PW gain vector, i.e., $$\sigma=\mathrm{MIN}(1.6,\mathrm{MAX}(1.1,(g_{k-2}(5)/g_B(0,k-2))^{0.2}))$$

9.13.5 Voicing Measure

The voicing measure lies in the range [0,1] and is encoded using a 3 bit index. Small values of the voicing measure or low values of the voicing measure index correspond to high degree of voicing and vice-versa.

The bad frame masking procedure works in two stages. In the first stage we exploit the correlation between the VAD likelihood and the voicing measure index. In the second stage the correlation between the reconstructed spectrally weighted SEW RMS value in the [80–1250] Hz band and the voicing measure is exploited. The reconstruction of SEW magnitude takes place between the two stages. Denoting the voicing measure index for frame k−3 as $I_v(k-3)$, we estimate the voicing measure index for the bad frame $I_v(k-2)$ in the first stage using the following logic:

$$\begin{aligned} I_v(k-2) &= \mathrm{MAX}(I_v(k-3)-1, 0) && \text{if } v_L(k-2)>2 \\ &= \mathrm{MIN}(I_v(k-3)+1, 7) && \text{if } v_L(k-2)<2 \\ &= I_v(k-3) && \text{otherwise.} \end{aligned}$$

Basically, the estimated voicing measure index pushes the previous voicing measure index in the direction of high degree of voicing if the VAD likelihood is high and conversely pushes the voicing measure index in the direction of low degree of voicing if the VAD likelihood is low and leaves the previous voicing measure index unchanged for intermediate values of the VAD likelihood. After the reconstruction of the SEW magnitude, the second stage of bad frame masking computes the reconstructed SEW rms $g_{sew}^{lo}(k-2)$ in the low frequency band [80,1250] Hz and then exploits the correlation between $g_{sew}^{lo}(k-2)$ and the voicing measure index $I_v(k-2)$ as follows:

$$I_v(k-2) = \mathrm{MAX}(I_v(k-2)-1, 0) \quad \text{if } g^{lo}_{sew}(k-2) > 0.9$$
$$= \mathrm{MIN}(I_v(k-2)+1, 7) \quad \text{if } g^{lo}_{sew}(k-2) < 0.6$$
$$= I_v(k-2) \quad \text{otherwise.}$$

Basically, the estimated voicing measure index edges lower in the direction of high degree of voicing if the SEW RMS in the low frequency band is high and conversely edges higher in the direction of low degree of voicing if the SEW RMS in the low frequency band is low.

There is no explicit bad frame recovery procedure for the voicing measure parameter.

9.13.6 SEW Magnitude

The SEW magnitude is quantized using a switched predictive mean-gain-shape VQ. The predictive mode bit which determines the predictor coefficient of the mean VQ and that of the gainshape VQ, the mean VQ index, the RMS or gain quantization index, and the shape VQ index are all unpacked from the compressed speech packet and used in the reconstruction of the SEW magnitude vector.

In the event of a bad frame indication, the SEW magnitude would have to be estimated entirely based on its past history. This is done by forcing the predictive mode bit to 1, increasing the SEW mean predictor coefficient to 0.95 but zeroing out the mean VQ contribution, and zeroing out the SEW rms value. Such a masking procedure makes effective use of the high inter-frame correlation of the SEW mean and the moderate inter-frame correlation of the RMS-shape. Furthermore, the selection of the SEW mean VQ codebook based on the voicing measure does not affect the reconstructed SEW since the mean VQ contribution is zeroed out anyway. As many consecutive corrupt speech packets are received, the SEW RMS-shape contribution decays to zero very quickly since its predictor coefficient is only 0.6 leaving the SEW mean to decay very slowly to zero.

There is no explicit bad frame recovery procedure associated with the SEW magnitude.

9.13.7 REW Magnitude Gain

The REW magnitude gain is estimated every 4 ms using the quantized SEW mean, Deviations from this estimate are quantized using a 5 dimensional 5 bit VQ. At the receiver, the 5 dimensional correction vector is reconstructed by inverse VQ. The REW magnitude gain estimate is also reconstructed at the decoder and the correction added to it every 4 ms. The REW magnitude gain is interpolated to obtain the intermediate values.

In the event of a bad frame indication, the REW magnitude correction vector is discarded and the REW magnitude gain is taken to be the estimate itself. There is no explicit bad frame recovery associated with the REW magnitude gain.

While there has been illustrated and described particular embodiments of low rate encoding of prototype waveform components, it will be appreciated that numerous changes and modifications will occur to those skilled in the art. Thus, it is intended that the appended claims define the scope of the invention and cover changes and modifications, which fall within the true state, and scope of the present invention.

What is claimed is:

1. A frequency domain interpolative coding system for low bit-rate coding of speech signals, comprising:

a linear prediction (LP) front end responsive to an input signal providing LP parameters which are quantized and encoded over predetermined intervals and used to compute a LP residual signal;

an open loop pitch estimator responsive to said LP residual signal, a pitch quantizer, and a pitch interpolator yielding a pitch contour within the predetermined interval;

a signal processor responsive to said LP residual signal and the pitch contour for extracting a prototype waveform (PW) for a number of equal subintervals within the predetermined interval;

said signal processor computing a PW gain for generating a normalized PW for each sub-interval and a PW gain vector for the predetermined interval;

a low pass filter and a decimator for the PW gain sequence, yielding a decimated PW gain vector;

vector quantizer (VQ) operating on the decimated PW gain vector using a codebook comprising a section representative of steady state gain inputs and a section representative of transient gain inputs.

2. A system as recited in claim 1, wherein said signal processor provides error concealment for the PW gain in the coding system by decaying an average measure of PW gain obtained from two or more predetermined intervals, and increasing the rate of decay with the number of erased frames.

3. A frequency domain interpolative coding system for low bit-rate coding of speech signals, comprising:

a linear prediction (LP) front end responsive to an input signal providing parameters which are quantized using a backward adaptive predictive multi-stage VQ for each predetermined interval and used to compute a LP residual signal;

an open loop pitch estimator responsive to said LP residual signal, a pitch quantizer, and a pitch interpolator yielding a pitch contour within the predetermined interval;

a signal processor responsive to said LP residual signal and the pitch contour for extracting a prototype waveform (PW) for a number of equal sub-intervals within the predetermined interval;

signal processor computing a PW gain for generating a normalized PW for each sub-interval and a PW gain vector for the predetermined interval;

a low pass filter and a decimator for the PW gain sequence, yielding a decimated PW gain vector;

a vector quantizer (VQ) operating on the decimated PW gain vector using a codebook comprising a section representative of steady state gain inputs and a section representative of transient gain inputs.

4. A system as recited in claim 2, comprising:

a voice activity detector (VAD) mechanism responsive to said LP parameters and open loop pitch, generating a VAD flag for each predetermined interval, quantized and transmitted;

a voicing measure, which characterizes the degree of the periodicity of the input signal, responsive to a set of parameters correlated to the degree of signal periodicity, computed using the input signal, LP residual, PW, SEW and REW;

a decoder responsive to said VAD for computing a VAD likelihood measure at the decoder by summing previously received VAD flags;

said decoder determining a degree of bandwidth broadening at the decoder based on said VAD likelihood measure and the received voicing measure; and a signal processor for providing adaptive bandwidth broadening based on said degree of bandwidth broadening applied to the LP synthesis filter coefficients at the decoder, to mitigate artifacts in the reconstructed signal due to spurious spectral peaks.

5. A system as recited in claim 4, comprising:

a low-pass filter for extracting a slowly evolving waveform (SEW) from the prototype waveform along each pitch harmonic track;

a high-pass filter for extracting a rapidly evolving waveform (REW) from the prototype waveform along each pitch harmonic track; and vector quantizer for quantizing the SEW spectral magnitude vector using a mean-gain-shape method.

6. A system as recited in claim 5, comprising a vector quantizer for quantizing the REW spectral magnitude vector using a gain sub-band averaged shape method.

7. A system as recited in claim 6, wherein the SEW phase component is reconstructed at the decoder for every subinterval of a predetermined interval based on the received voicing measure, pitch contour, SEW and REW magnitudes.

8. A system as recited in claim 7, wherein the REW phase component is reconstructed at the decoder for every subinterval as the phase of the complex output of an adaptive filter, driven by a weighted combination of the complex SEW signal and a complex random noise process with the same energy as the SEW.

9. A system as recited in claim 8, wherein said decoder generates an excitation signal derived by conversion to time-domain of the gain scaled sum of the reconstructed SEW and REW components; and wherein said signal processor reconstructs speech as the output of the adaptively bandwidth broadened LP synthesis filter, driven by said excitation signal, further comprising a filter for postfiltering the reconstructed speech using a global pole-zero postfilter, whose parameters are derived from adaptively bandwidth broadened LP synthesis filter parameters.

10. A system as recited in claim 9, wherein said decoder generates an error concealment mechanism for the line spectral frequency (LSF) parameters based on replacing the errored parameters by ones generated using a higher value for the fixed prediction coefficient in the predictive inverse-VQ; and provides an error recovery mechanism whereby the LSF parameters of the previous frame are also replaced by an average of the parameters of the current frame and parameters from two frames ago, so that the LSF parameters evolve smoothly.

11. A system as recited in claim 10, wherein said decoder generates an error concealment mechanism for the open loop pitch parameter based on repetition of the pitch value of the previous frame; and provides an error recovery mechanism based on either repetition or averaging to obtain the pitch value of the previous frame, depending on the number of bad frames that have elapsed.

12. A system as recited in claim 11, wherein said decoder generates an error concealment for the PW gain in the coding system by decaying an average measure of PW gain obtained from two or more predetermined intervals, and increasing the rate of decay with the number of erased frames; and provides an error recovery mechanism.

13. A system as recited in claim 12, wherein said decoder provides an error concealment mechanism for the VAD likelihood measure by setting the VAD flag for the most recently received frames to indicate active speech, thereby reducing the degree of adaptive bandwidth broadening.

* * * * *